US008925506B2

(12) United States Patent
Watanabe

(10) Patent No.: US 8,925,506 B2
(45) Date of Patent: Jan. 6, 2015

(54) VALVE TIMING CONTROL APPARATUS OF INTERNAL COMBUSTION ENGINE

(75) Inventor: Atsushi Watanabe, Atsugi (JP)

(73) Assignee: Hitachi Automotive Systems, Ltd., Hitachinaka-shi (JP)

( * ) Notice: Subject to any disclaimer, the term of this patent is extended or adjusted under 35 U.S.C. 154(b) by 21 days.

(21) Appl. No.: 13/614,176

(22) Filed: Sep. 13, 2012

(65) Prior Publication Data

US 2013/0104820 A1 May 2, 2013

(30) Foreign Application Priority Data

Oct. 26, 2011 (JP) ..... 2011-234693

(51) Int. Cl.
*F01L 1/34* (2006.01)
*F01L 1/344* (2006.01)

(52) U.S. Cl.
CPC ..... *F01L 1/3442* (2013.01); *F01L 2001/34479* (2013.01); *F01L 2001/34469* (2013.01); *F01L 2001/34459* (2013.01)
USPC ..... 123/90.17

(58) Field of Classification Search
USPC ..... 123/90.15, 90.17
See application file for complete search history.

(56) References Cited

U.S. PATENT DOCUMENTS

| | | | | |
|---|---|---|---|---|
| 2011/0067657 | A1* | 3/2011 | Strauss | 123/90.15 |
| 2012/0103289 | A1* | 5/2012 | Kato et al. | 123/90.15 |
| 2012/0227692 | A1* | 9/2012 | Hoyer et al. | 123/90.15 |
| 2013/0180481 | A1* | 7/2013 | Kato et al. | 123/90.15 |

FOREIGN PATENT DOCUMENTS

JP 2010-195308 A 9/2010

* cited by examiner

*Primary Examiner* — Thomas Denion
*Assistant Examiner* — Steven D Shipe
(74) *Attorney, Agent, or Firm* — Foley & Lardner LLP

(57) ABSTRACT

In a valve timing control apparatus configured to enable rotary motion of a vane rotor relative to a sprocket in a phase-retard direction or in a phase-advance direction by controlling hydraulic-pressure supply-and-exhaust for each of phase-advance hydraulic chambers and hydraulic-pressure supply-and-exhaust for each of phase-retard hydraulic chambers, first and second lock pins are located in a large-diameter rotor portion rather than a small-diameter rotor portion. The rotary motion of the vane rotor relative to the sprocket from an intermediate lock position between a maximum phase-advance position and a maximum phase-retard position is restricted by engagement of the first lock pin with a first lock hole and by engagement of the second lock pin with a second lock hole. The vane rotor is held at the maximum phase-retard position by engagement of the first lock pin with the second lock hole.

19 Claims, 8 Drawing Sheets

VALVE TIMING CONTROL APPARATUS OF INTERNAL COMBUSTION ENGINE

TECHNICAL FIELD

The present invention relates to a valve timing control apparatus of an internal combustion engine for variably controlling valve timing of an engine valve, such as an intake valve and/or an exhaust valve, depending on an engine operating condition.

BACKGROUND ART

In recent years, there have been proposed and developed various valve timing control devices, configured to realize a so-called "Atkinson cycle" by controlling intake-valve timing to an angular phase retarded from an intermediate phase between a maximum phase-retard position and a maximum phase-advance position when starting an internal combustion engine from cold, thus creating an expansion ratio higher than an effective compression ratio.

However, in a hybrid electric vehicle (HEV) or an idling-stop system equipped automotive vehicle, in which an internal combustion engine can be automatically stopped without any driver's intention, the vehicle is restarted usually under a high engine temperature condition. Thus, it is necessary to restart the engine at the valve timing, retarded with respect to the intermediate phase suited for cold-engine starting.

Hence, Japanese Patent Provisional Publication No. 2010-195308 (hereinafter is referred to as "JP2010-195308") teaches a controller for a hybrid vehicle employing a variable valve timing control (VTC) device, configured to hold the valve timing at an intermediate phase so as to ensure a good startability during engine cold-start operation where the engine is started by manually turning an ignition switch ON, and also configured to hold the valve timing at an angular phase retarded from the intermediate phase so as to reduce noise and vibrations of the engine during automatic engine restart operation.

SUMMARY OF THE INVENTION

However, in the valve timing control device as disclosed in JP2010-195308, when the engine is stopped by manually turning the ignition switch OFF, a vane rotor of the VTC device is held at an angular position corresponding to the intermediate phase mechanically by engaging a lock pin with a lock hole. Conversely when the engine is automatically stopped by means of the idling-stop system without manually turning OFF the ignition switch kept in an ON condition, the vane rotor is held hydraulically at an angular position retarded from the intermediate phase rather than mechanically. For this reason, the system of JP2010-195308 requires a separate hydraulic pressure source for hydraulically holding the vane rotor at the retarded angular position than the intermediate phase.

Accordingly, it is an object of the invention to provide a valve timing control apparatus of an internal combustion engine capable of holding the valve timing mechanically at a specified phase rather than having to be held hydraulically at the specified phase, even when the engine is automatically stopped by means of an idling-stop system.

In order to accomplish the aforementioned and other objects of the present invention, a valve timing control apparatus of an internal combustion engine, comprises a housing adapted to be driven by a crankshaft of the engine, and configured to define a working-fluid chamber therein by partitioning an internal space by shoes protruding radially inward from an inner peripheral surface of the housing, a vane rotor having a rotor adapted to be fixedly connected to a camshaft and radially-extending vanes formed on an outer periphery of the rotor for partitioning the working-fluid chamber of the housing by the shoes and the vanes to define phase-advance hydraulic chambers and phase-retard hydraulic chambers, a stopper for restricting an angular range of relative rotation of the vane rotor with respect to the housing, a first locking member located in the vane rotor and configured to extend or retract as necessary, a second locking member located in the vane rotor and configured to extend or retract as necessary, a first lock recessed portion located in the housing, and configured to restrict rotary motion of the vane rotor relative to the housing in a phase-retard direction from an intermediate lock position between a maximum phase-advance position and a maximum phase-retard position by engagement of the first locking member with the first lock recessed portion, and a second lock recessed portion located in the housing, and configured to restrict rotary motion of the vane rotor relative to the housing in a phase-advance direction from the intermediate lock position by engagement of the second locking member with the second lock recessed portion, and configured to hold the vane rotor at the intermediate lock position in cooperation with engagement of the first locking member with the first lock recessed portion, and further configured to hold the vane rotor at the maximum phase-retard position by restricting the rotary motion of the vane rotor in the phase-advance direction by engagement of the first locking member with the second lock recessed portion under a state where the rotary motion of the vane rotor relative to the housing in the phase-retard direction is restricted by the stopper.

According to another aspect of the invention, a valve timing control apparatus of an internal combustion engine, comprises a driving rotary member adapted to be driven by a crankshaft of the engine, a driven rotary member adapted to be fixedly connected to a camshaft and configured to change, depending on an operating condition of the engine, a relative-rotation angle of the driven rotary member with respect to the driving rotary member within a predetermined angular range, a phase change mechanism having phase-advance hydraulic chambers and phase-retard hydraulic chambers, and configured to rotate the driven rotary member relative to the driving rotary member in a phase-advance direction by supplying hydraulic pressure to each of the phase-advance hydraulic chambers and exhausting working fluid from each of the phase-retard hydraulic chambers and configured to rotate the driven rotary member relative to the driving rotary member in a phase-retard direction by supplying hydraulic pressure to each of the phase-retard hydraulic chambers and exhausting working fluid from each of the phase-advance hydraulic chambers, a first locking member and a second locking member, each of which is configured to extend or retract as necessary, a first lock recessed portion configured to restrict rotary motion of the driven rotary member relative to the driving rotary member in a phase-retard direction from an intermediate lock position between a maximum phase-advance position and a maximum phase-retard position by engagement of the first locking member with the first lock recessed portion, and a second lock recessed portion configured to restrict rotary motion of the driven rotary member relative to the driving rotary member in a phase-advance direction from the intermediate lock position by engagement of the second locking member with the second lock recessed portion, and configured to hold the driven rotary member at the maximum phase-retard position by engagement of the first locking member with the second lock recessed portion.

According to a further aspect of the invention, a valve timing control apparatus of an internal combustion engine, comprises a housing adapted to be driven by a crankshaft of the engine, and configured to define a working-fluid chamber therein by partitioning an internal space by shoes protruding radially inward from an inner peripheral surface of the housing, a vane rotor having a rotor adapted to be fixedly connected to a camshaft and radially-extending vanes formed on an outer periphery of the rotor for partitioning the working-fluid chamber of the housing by the shoes and the vanes to define phase-advance hydraulic chambers and phase-retard hydraulic chambers, a stopper for restricting an angular range of relative rotation of the vane rotor with respect to the housing, a first locking member located in the vane rotor and configured to extend or retract as necessary, a second locking member located in the vane rotor and configured to extend or retract as necessary, a third locking member located in the vane rotor and configured to extend or retract as necessary, a first lock recessed portion configured to restrict rotary motion of the driven rotary member relative to the driving rotary member in a phase-retard direction from an intermediate lock position between a maximum phase-advance position and a maximum phase-retard position by engagement of the first locking member with the first lock recessed portion, a second lock recessed portion configured to restrict rotary motion of the driven rotary member relative to the driving rotary member in a phase-advance direction from the intermediate lock position by engagement of the second locking member with the second lock recessed portion, and a third lock recessed portion located in the housing, and having a stepped portion whose bottom face lowers stepwise in the phase-advance direction, and configured to guide the first locking member toward the first lock recessed portion by virtue of movement of the third locking member into engagement with the third lock recessed groove, and further configured to hold the vane rotor at the maximum phase-retard position by restricting the rotary motion of the vane rotor in the phase-advance direction by engagement of the second locking member with the third lock recessed portion under a state where the rotary motion of the vane rotor relative to the housing in the phase-retard direction is restricted by the stopper.

According to a still further aspect of the invention, a valve timing control apparatus of an internal combustion engine, comprises a housing adapted to be driven by a crankshaft of the engine, and configured to define a working-fluid chamber therein, a vane rotor having a rotor adapted to be fixedly connected to a camshaft and vanes for partitioning the working-fluid chamber into phase-advance hydraulic chambers and phase-retard hydraulic chambers, and configured to phase-advance with respect to the housing by supplying hydraulic pressure to each of the phase-advance hydraulic chambers, while exhausting working fluid from each of the phase-retard hydraulic chambers and configured to phase-retard with respect to the housing by supplying hydraulic pressure to each of the phase-retard hydraulic chambers, while exhausting working fluid from each of the phase-advance hydraulic chambers, a first locking member located in the vane rotor and configured to extend or retract as necessary, a second locking member located in the vane rotor and configured to extend or retract as necessary, a first lock recessed portion located in the housing, and configured to restrict rotary motion of the vane rotor relative to the housing in a phase-retard direction from an intermediate lock position between a maximum phase-advance position and a maximum phase-retard position by engagement of the first locking member with the first lock recessed portion, and a second lock recessed portion located in the housing, and configured to restrict rotary motion of the vane rotor relative to the housing in a phase-advance direction from the intermediate lock position by engagement of the second locking member with the second lock recessed portion, and further configured to hold the vane rotor at the maximum phase-retard position by engagement of the first locking member with the second lock recessed portion.

The other objects and features of this invention will become understood from the following description with reference to the accompanying drawings.

DESCRIPTION OF THE PREFERRED EMBODIMENTS

Figure 1:
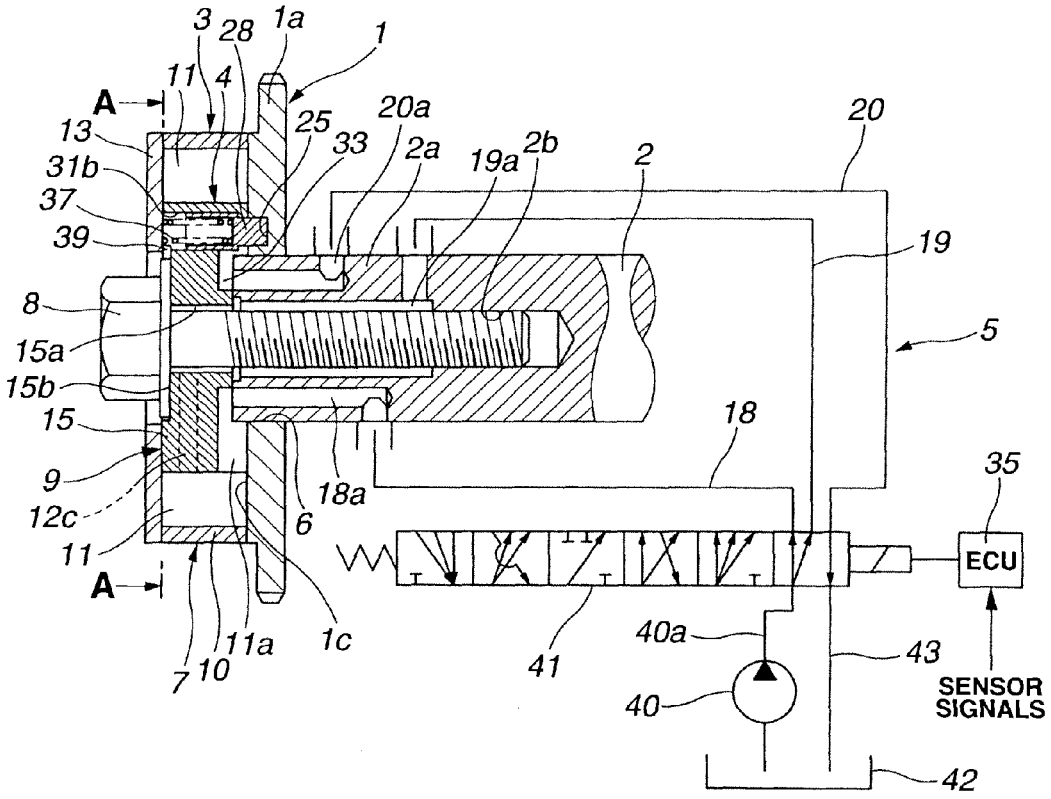
FIG. 1 is a system diagram illustrating an embodiment of a valve timing control apparatus.
Figure 2:
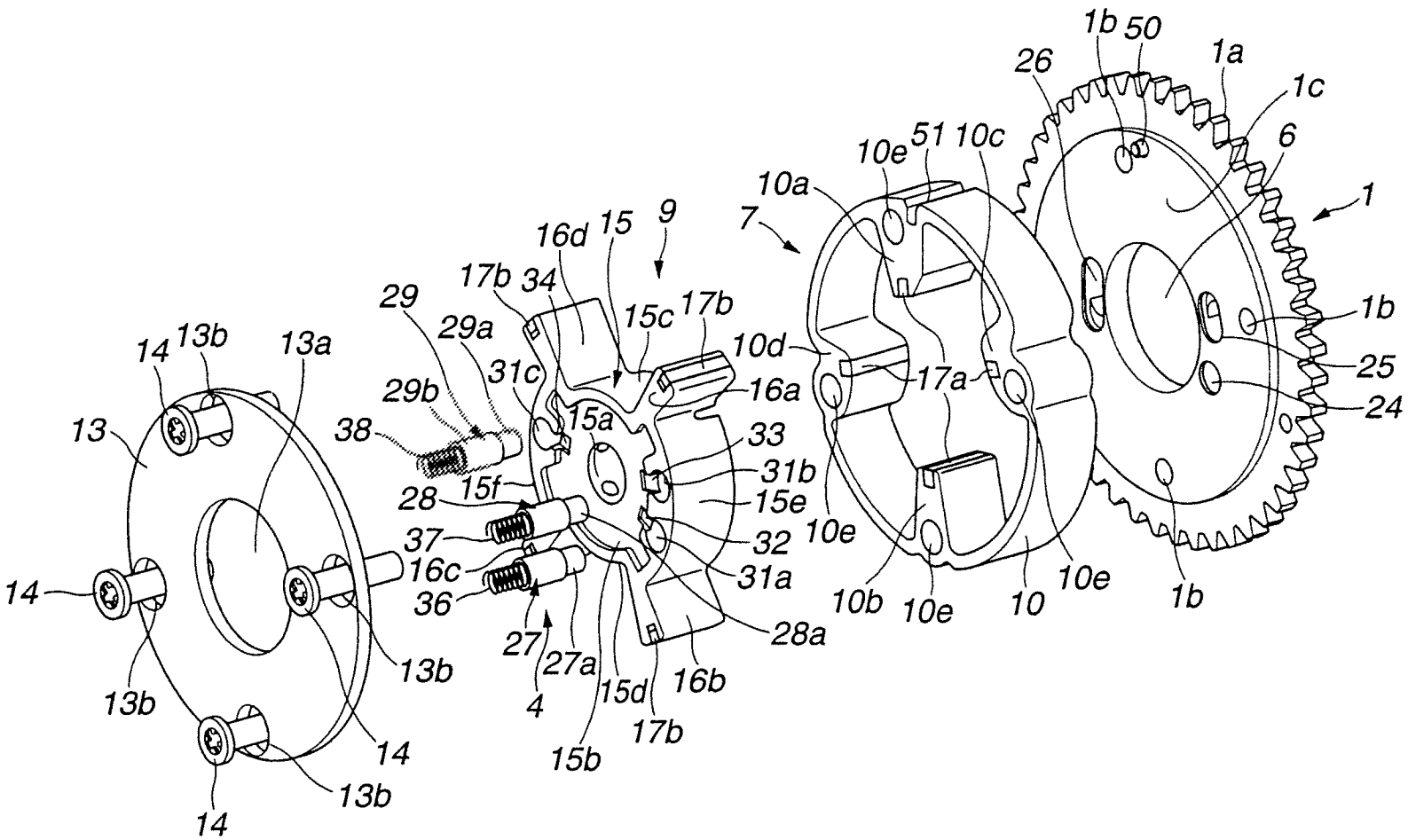
FIG. 2 is an exploded perspective view illustrating the valve timing control (VTC) apparatus of the embodiment, highlighting the essential part of the apparatus.
Figure 3:
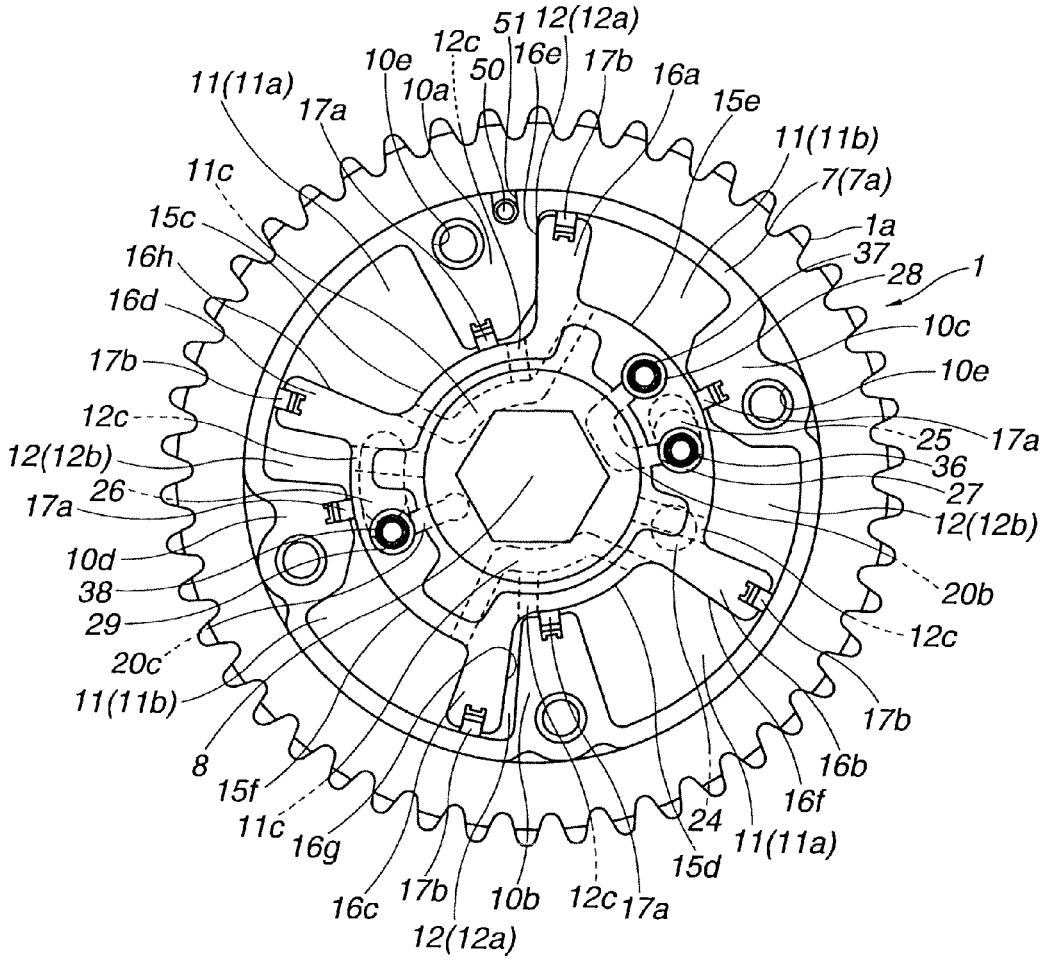
FIG. 3 is a cross-sectional view taken along the line A-A in FIG. 1 and showing a maximum phase-retard state where the vane rotor of the VTC apparatus of the embodiment has been rotated to an angular position corresponding to a maximum retarded phase.

Referring now to the drawings, particularly to FIGS. 1-3, the valve timing control apparatus of the embodiment is exemplified in a phase control apparatus which is applied to an intake-valve side of an internal combustion engine of a hybrid electric vehicle (HEV), an idling-stop system equipped automotive vehicle, and the like.

As shown in FIGS. 1-3, the valve timing control apparatus includes a timing sprocket 1 driven by an engine crankshaft via a timing chain and serving as a driving rotary member, an intake-valve side camshaft 2 arranged in a longitudinal direction of the engine and configured to be relatively rotatable with the sprocket 1, a phase-change mechanism 3 installed between sprocket 1 and camshaft 2 to change a relative angular phase of camshaft 2 to sprocket 1 (the crankshaft), a lock mechanism 4 provided for locking or holding the phase-change mechanism 3 at a maximum phase-retard position as well as an intermediate-phase angular position between a maximum phase-advance position and the maximum phase-retard position, and a hydraulic circuit 5 provided for hydraulically operating phase-change mechanism 3 and lock mechanism 4 independently of each other.

Sprocket 1 is constructed as a rear cover that hermetically closes the rear end opening of a housing (described later). Sprocket 1 is formed into a thick-walled disc-shape. The outer periphery of sprocket 1 has a toothed portion 1*a* on which the timing chain is wound. Sprocket 1 is also formed with a supported bore 6 (a central through hole), which is rotatably supported on the outer periphery of one axial end 2*a* of camshaft 2. Also, sprocket 1 has circumferentially equidistant-spaced four female-screw threaded holes 1*b* formed on its outer peripheral side.

Camshaft 2 is rotatably supported on a cylinder head (not shown) via cam bearings (not shown). Camshaft 2 has a plurality of cams integrally formed on its outer periphery and spaced apart from each other in the axial direction of camshaft 2, for operating engine valves (i.e., intake valves). Camshaft 2 has a female-screw threaded hole 2*b* formed along the camshaft center at the axial end 2*a*.

As shown in FIGS. 1-3, phase-change mechanism 3 is comprised of a housing 7, a vane rotor 9, four phase-retard hydraulic chambers (simply, four phase-retard chambers) 11, 11, 11, 11 and four phase-advance hydraulic chambers (simply, four phase-advance chambers) 12, 12, 12, 12. Housing 7 is integrally connected to the sprocket 1 in the axial direction. Vane rotor 9 is fixedly connected to the axial end of camshaft 2 by means of a cam bolt 8 screwed into the female screw-threaded hole 2*b* of the axial end of camshaft 2, and serves as a driven rotary member rotatably enclosed in the housing 7. Housing 7 has radially-inward protruded four shoes (described later) integrally formed on the inner peripheral surface of housing 7. Four phase-retard chambers 11 and four phase-advance chambers 12 are defined by partitioning the working-fluid chamber (the internal space) of housing 7 by four shoes of housing 7 and four vanes (described later) of vane rotor 9.

Housing 7 includes a cylindrical housing body 10, a front plate 13, and the sprocket 1 serving as the rear cover for the rear opening end of housing 7. Housing body 10 is formed as a cylindrical hollow housing member, opened at both ends in the two opposite axial directions. Front plate 13 is produced by pressing. Front plate 13 is provided for hermetically covering the front opening end of housing body 10.

Housing body 10 is made of sintered alloy materials, such as iron-based sintered alloy materials. Housing body 10 has four radially-inward protruded shoes 10*a*, 10*b*, 10*c*, and 10*d*, integrally formed on its inner periphery. Four bolt insertion holes, namely axial through holes 10*e*, 10*e*, 10*e*, 10*e* are formed in respective shoes 10*a*-10*d*.

Front plate 13 is formed as a thin-walled metal disc. Front plate 13 is formed with a central through hole 13*a*. Also, front plate 13 has four circumferentially equidistant-spaced bolt insertion holes, namely axial through holes 13*b*, 13*b*, 13*b*, 13*b*.

Sprocket 1, housing body 10, and front plate 13 are integrally connected to each other by fastening them together with four bolts 14, 14, 14, 14 penetrating respective bolt insertion holes (i.e., four through holes 13*b* formed in the front plate 13 and four through holes 10*e* formed in respective shoes 10*a*-10*d*) and screwed into respective female-screw threaded holes 1*b* of sprocket 1.

In FIGS. 2-3, a pin denoted by reference sign 50 is a positioning pin attached onto the inner face 1*c* of sprocket 1, whereas an axially-elongated groove denoted by reference sign 51 is a positioning groove formed in the outer periphery of the first shoe 10*a* of housing body 10. When assembling, the positioning pin 50 of sprocket 1 is fitted into the positioning groove 51 of the first shoe 10*a* of housing body 10, thus ensuring easy positioning of housing body 10 relative to the sprocket 1.

Vane rotor 9 is formed of a metal material. Vane rotor 9 is comprised of a rotor 15 fixedly connected to the axial end of camshaft 2 by means of the cam bolt 8, and four radially-extending vane blades (simply, vanes) 16*a*, 16*b*, 16*c*, and 16*d*, formed on the outer periphery of rotor 15 and circumferentially spaced apart from each other by approximately 90 degrees.

Rotor 15 is formed into an axially-thick-walled, different-diameter deformed disc-shape. Rotor 15 is integrally formed with a central bolt insertion hole (an axial through hole) 15*a*. A substantially circular recessed bearing surface 15*b*, on which the head of cam bolt 8 is seated, is formed in the front end face of rotor 15.

Regarding the shape of rotor 15, in particular, the lateral cross-sectional configuration of rotor 15, the contour between the first vane 16*a* and the fourth vane 16*d* circumferentially adjacent to each other is configured as a small-diameter portion 15*c*, whereas the contour between the second vane 16*b* and the third vane 16*c* circumferentially adjacent to each other is also configured as a small-diameter portion 15*d*. The small-diameter pair (i.e., the first small-diameter portion 15*c* and the second small-diameter portion 15*d*) serves as a base circle. In contrast, the contour between the first vane 16*a* and the second vane 16*b* circumferentially adjacent to each other is configured as a first large-diameter portion 15*e* having an outside diameter greater than the first and second small-diameter portions 15*c*-15*d*. Also, the contour between the third vane 16*c* and the fourth vane 16*d* circumferentially adjacent to each other is configured as a second large-diameter portion 15*f* having an outside diameter greater than the first and second small-diameter portions 15*c*-15*d*.

First small-diameter portion 15*c* and second small-diameter portion 15*d* are arranged at angular positions circumferentially spaced apart from each other by approximately 180 degrees. That is, first and second small-diameter portions 15*c*-15*d* are arranged to be diametrically opposed to each other. The outer peripheral surface of each of first and second small-diameter portions 15*c*-15*d* is formed into a circular-arc shape having the same radius of curvature.

On the other hand, first and second large-diameter portions 15*e*-15*f* are arranged at angular positions circumferentially spaced apart from each other by approximately 180 degrees. That is, first and second large-diameter portions 15*e*-15*f* are also arranged to be diametrically opposed to each other. The outer peripheral surface of each of first and second large-diameter portions 15*e*-15*f* is formed into a circular-arc shape having the same radius of curvature. However, the outside diameter of the outer peripheral surfaces of large-diameter portions 15*e*-15*f* is configured to be one-size greater than that of small-diameter portions 15*c*-15*d*.

Therefore, the first shoe 10*a*, whose tip faces the outer peripheral surface of first small-diameter portion 15*c*, is formed as a comparatively long, radially-inward protruded partition wall having substantially rectangular side faces. In a similar manner, the second shoe 10*b*, whose tip faces the outer peripheral surface of second small-diameter portion 15*d*, is formed as a comparatively long, radially-inward protruded partition wall having substantially rectangular side faces. In contrast, the third shoe 10*c*, whose tip faces the outer peripheral surface of first large-diameter portion 15*e*, is formed as a comparatively short, radially-inward protruded partition wall having substantially circular-arc side faces. In a similar manner, the fourth shoe 10*d*, whose tip faces the outer peripheral surface of second large-diameter portion 15*f*, is formed as a comparatively short, radially-inward protruded partition wall having substantially circular-arc side faces.

Four shoes 10*a*-10*d* have respective axially-elongated seal retaining grooves, formed in their innermost ends (apexes) and extending in the axial direction. Each of four seal retaining grooves of the shoes is formed into a substantially rectangle. Four oil seal members (four apex seals) 17*a*, 17*a*, 17*a*, 17*a*, each having a substantially square lateral cross section, are fitted into respective seal retaining grooves of four shoes 10*a*-10*d* so as to bring the four apex seals 17*a* into sliding-contact with the respective outer peripheral surfaces of first and second small-diameter portions 15*c*-15*d* and first and second large-diameter portions 15*e*-15*f*. Leaf springs (not shown) are installed in the respective seal retaining grooves of four shoes 10*a*-10*d*, for permanently biasing the four apex seals of four shoes 10*a*-10*d* toward the respective outer peripheral surfaces of first and second small-diameter portions 15*c*-15*d* and first and second large-diameter portions 15*e*-15*f*, thereby providing a sealing action between the different-diameter deformed outer peripheral surface of rotor 15 and the innermost ends (apexes) of shoes 10*a*-10*d*.

Regarding four vanes 16*a*-16*d* formed integral with the rotor 15 and radially extending outward from the outer peripheral surface of rotor 15, their entire lengths are dimensioned to be substantially identical to each other. Circumferential widths of four vanes 16*a*-16*d* are dimensioned to be substantially identical to each other, and thus each of vanes 16*a*-16*d* is formed into a thin-walled plate. Four vanes 16*a*-16*d* are disposed in respective internal spaces defined by four shoes 10*a*-10*d*. In a similar manner to the four shoes 10*a*-10*d*, four vanes 16*a*-16*d* have respective axially-elongated seal retaining grooves, formed in their outermost ends (apexes) and extending in the axial direction. Each of four seal retaining grooves of the vanes is formed into a substantially rectangle. Four oil seal members (four apex seals) 17*b*, 17*b*, 17*b*, 17*b*, each having a substantially square lateral cross section, are fitted into respective seal retaining grooves of four vanes 16*a*-16*d* so as to bring the four apex seals 17*b* into sliding-contact with the inner peripheral surface of housing body 10. Leaf springs (not shown) are installed in the respective seal retaining grooves of four vanes 16*a*-16*d*, for permanently biasing the four apex seals of four vanes 16*a*-16*d* toward the inner peripheral surface of housing body 10, thereby providing a sealing action between the inner peripheral surface of housing body 10 and the outermost ends (apexes) of vanes 16*a*-16*d*.

As discussed above, apex seals 17*a* of shoes 10*a*-10*d* and apex seals 17*b* of vanes 16*a*-16*d* are cooperated with each other to ensure a fluid-tight sealing structure between phase-retard chamber 11 and phase-advance chamber 12.

Figure 5:
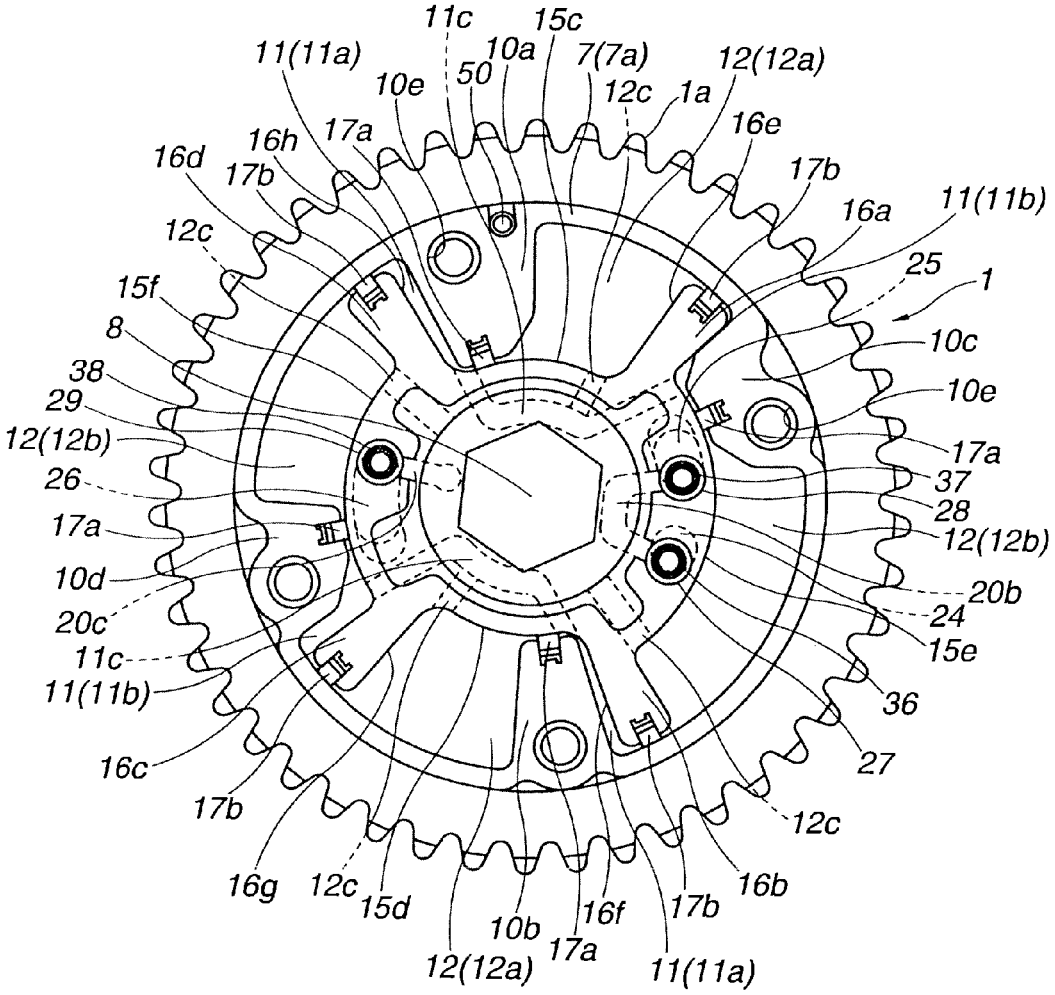
FIG. 5 is a cross-sectional view taken along the line A-A in FIG. 1 and showing a maximum phase-advance state where the vane rotor of the VTC apparatus has been rotated to an angular position corresponding to a maximum advanced phase.

As shown in FIG. 3, when vane rotor 9 rotates relative to the housing 7 (or the sprocket 1) in the phase-retard direction, one side face (an anticlockwise side face 16*e*, viewing FIG. 3) of the first vane 16*a* is brought into abutted-engagement with a radially-inward protruding surface formed on one side face (a clockwise side face, viewing FIG. 3) of the opposed first shoe 10*a*, and thus a maximum phase-retard angular position of vane rotor 9 is restricted. Conversely, as shown in FIG. 5, when vane rotor 9 rotates relative to the housing 7 (or the sprocket 1) in the phase-advance direction, the other side face (a clockwise side face, viewing FIG. 5) of the first vane 16*a* is brought into abutted-engagement with a radially-inward protruding surface formed on one side face (an anticlockwise side face, viewing FIG. 5) of the opposed third shoe 10*c*, and thus a maximum phase-advance angular position of vane rotor 9 is restricted. That is, the third shoe 10*c* cooperates with the first vane 16*a* to provide a stopper function (i.e., a maximum phase-advance side stopper) for restricting a maximum phase-advance angular position of vane rotor 9 (in other words, rotary motion of vane rotor 9 relative to sprocket 1 in the phase-advance direction). In a similar manner, the first shoe 10*a* cooperates with the first vane 16*a* to provide a stopper function (i.e., a maximum phase-retard side stopper) for restricting a maximum phase-retard angular position of vane rotor 9 (in other words, rotary motion of vane rotor 9 relative to sprocket 1 in the phase-retard direction).

With the first vane 16*a* kept in its maximum phase-retard angular position (see FIG. 3) or with the first vane 16*a* kept in its maximum phase-advance angular position (see FIG. 5), both side faces of each of the other vanes 16*b*-16*d* are kept in a spaced, contact-free relationship with respective side faces of the associated shoes. Hence, the accuracy of abutment between the vane rotor 9 and the shoe (i.e., the first shoe 10*a*) can be enhanced, and additionally the speed of hydraulic pressure supply to each of hydraulic chambers 11 and 12 can be increased, thus a responsiveness of normal-rotation/reverse-rotation of vane rotor 9 can be improved.

The previously-discussed four phase-retard chambers 11 and four phase-advance chambers 12 are defined by both side faces of each of vanes 16*a*-16*d* and both side faces of each of shoes 10*a*-10*d*. Regarding volumetric capacities of phase-retard chambers 11 and phase-advance chambers 12, by virtue of the different-diameter deformed outer peripheral surface of rotor 15, the total volumetric capacity of hydraulic chambers 11*a* and 12*a*, located in the area corresponding to the small-diameter portion (each of first and second small-diameter portions 15*c*-15*d*) of rotor 15, is set to be greater than the total volumetric capacity of hydraulic chambers 11*b* and 12*b*, located in the area corresponding to the large-diameter portion (each of first and second large-diameter portions 15*e*-15*f*). Thus, the pressure-receiving surface area of each of side faces 16*e*-16*h* of vanes 16*a*-16*d*, facing hydraulic chambers 11*a* and 12*a* located in the area corresponding to the small-diameter portion (each of first and second small-diameter portions 15*c*-15*d*), is set to be greater than that of each of side faces of vanes 16*a*-16*d*, facing hydraulic chambers 11*b* and 12*b* located in the area corresponding to the large-diameter portion (each of first and second large-diameter portions 15*e*-15*f*).

Each of phase-retard chambers 11 is configured to communicate with the hydraulic circuit 5 (described later) via the first communication hole 11*c* formed in the rotor 15. In a similar manner, each of phase-advance chambers 12 is configured to communicate with the hydraulic circuit 5 via the second communication hole 12*c* formed in the rotor 15.

Figure 4:
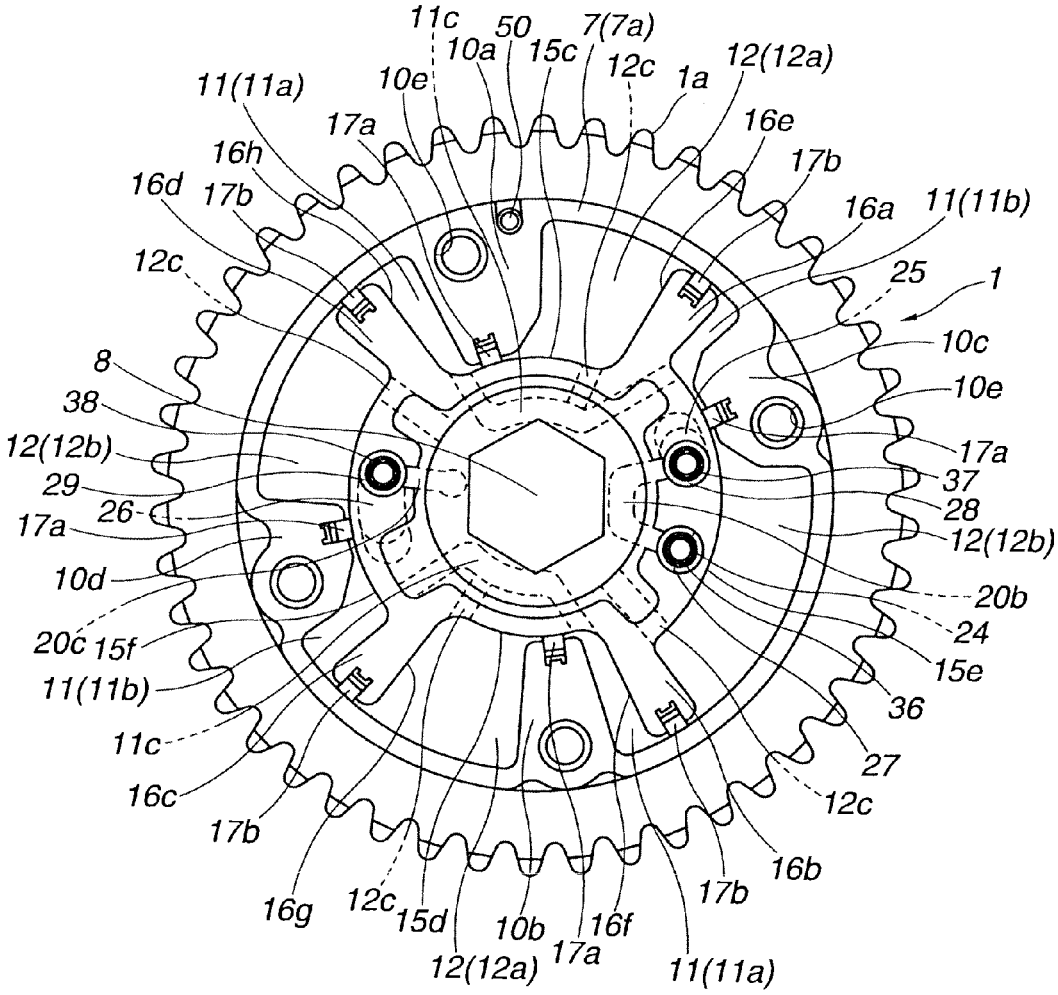
FIG. 4 is a cross-sectional view taken along the line A-A in FIG. 1 and showing an intermediate phase state where the vane rotor of the VTC apparatus is held at an angular position corresponding to an intermediate phase.

Lock mechanism 4 is provided for holding or locking an angular position of vane rotor 9 relative to housing 7 either at an intermediate-phase angular position, corresponding to the angular position (an intermediate lock position) of vane rotor 9 in FIG. 4 between the maximum phase-retard angular position (see FIG. 3) and the maximum phase-advance angular position (see FIG. 5), or at the maximum phase-retard angular position, depending on whether the engine is stopped manually by turning an ignition switch OFF or automatically stopped by means of an idling-stop system.

That is, as shown in FIGS. 2 and 6-11, lock mechanism 4 is comprised of a first lock hole 24, a second lock hole 25, a third lock hole 26, a first lock pin 27, a second lock pin 28, a third lock pin 29, and a lock-unlock passage (simply, a lock passage) 20. First, second and third lock holes 24-26 (serving as first, second and third lock recessed portions) are disposed in the inner face 1*c* of sprocket 1, and arranged at respective given circumferential positions. The first lock pin 27 (serving as a substantially cylindrical locking member engaged with the associated recessed portion) is operably disposed in the first large-diameter portion 15*e* of rotor 15 such that movement of first lock pin 27 into and out of engagement with the first lock hole 24 is permitted. The second lock pin 28 (serving as a substantially cylindrical locking member) is operably disposed in the first large-diameter portion 15*e* of rotor 15 such that movement of second lock pin 28 into and out of engagement with the second lock hole 25 is permitted. In a similar manner, the third lock pin 29 (serving as a substantially cylindrical locking member) is operably disposed in the second large-diameter portion 15*f* of rotor 15 such that movement of third lock pin 29 into and out of engagement with the third lock hole 26 is permitted. First, second and third lock pins 27-29 are arranged at respective given circumferential positions of rotor 15. Lock passage 20 is provided for disengagement of the first lock pin 27 from the first lock hole 24 and for disengagement of the second lock pin 28 from the second lock hole 25 and for disengagement of the third lock pin 29 from the third lock hole 26.

As seen in FIGS. 2 and 6-11, the first lock hole 24 is arranged on the side of first large-diameter portion 15*e*. The first lock hole 24 is formed into a cylindrical-hollow shape having an inside diameter greater than an outside diameter of the tip 27*a* of first lock pin 27 so as to permit a slight circumferential movement of the tip 27*a* of first lock pin 27 engaged with the first lock hole 24. Also, the first lock hole 24 is formed in the inner face 1*c* of sprocket 1 and arranged at an intermediate position somewhat displaced toward the phase-advance side with respect to the maximum phase-retard angular position of vane rotor 9. Additionally, the depth of the bottom face 24*a* of first lock hole 24 is dimensioned or set to be almost the same depth as the second bottom face 25*b* of second lock hole 25 and also dimensioned to be almost the same depth as the second bottom face 26*b* of third lock hole 26. Hence, in the presence of movement of first lock pin 27 into engagement with the first lock hole 24 owing to rotary motion of the vane rotor 9 in the phase-advance direction, the tip 27*a* of first lock pin 27 is brought into abutted-engagement with the bottom face 24*a* of first lock hole 24. At the same time, the outer periphery (the edge) of the tip 27*a* of first lock pin 27 is brought into abutted-engagement with the upstanding inner face 24*b* of first lock hole 24, and whereby rotary motion of vane rotor 9 in the phase-retard direction is restricted (see FIG. 11).

The second lock hole 25 is arranged on the side of first large-diameter portion 15*e*, in a similar manner to the first lock hole 24. The second lock hole 25 is formed into an elliptic or oval shape (a circumferentially-elongated groove) extending in the circumferential direction of sprocket 1. That is, the second lock hole 25 is formed as a two-stage stepped hole whose bottom face lowers stepwise from the phase-retard side to the phase-advance side. The second lock hole 25 (i.e., the two-stage stepped groove) is configured to serve as a second lock guide groove. That is, assuming that the inner face 1*c* of sprocket 1 is regarded as the uppermost level, the second lock guide groove (the two-stage stepped groove) 25 is configured to gradually lower from the first bottom face 25*a* to the second bottom face 25*b*, in that order. Each of inner faces, vertically extending from respective bottom faces 25*a*-25*b* on the phase-retard side, is formed as an upstanding wall surface (viewing FIGS. 6-11). The inner face 25*c*, vertically extending from the second bottom face 25*b* on the phase-advance side, is also formed as an upstanding wall surface (viewing FIGS. 6-11).

The second bottom face 25*b* is formed as a somewhat circumferentially-elongated recessed groove extending to the phase-advance side. With the tip 28*a* of second lock pin 28 engaged with the second bottom face 25*b*, the somewhat circumferentially-elongated second bottom face 25*b* permits a slight movement of second lock pin 28 in the phase-advance direction (see FIGS. 10-11).

The third lock hole 26 is arranged on the side of second large-diameter portion 15*f* and formed into a cocoon shape (or a circular-arc circumferentially-elongated groove) extending in the circumferential direction of sprocket 1 and dimensioned to be longer than the second lock hole 25. The third lock hole 26 is formed in the inner face 1*c* of sprocket 1 and arranged at an intermediate position somewhat displaced toward the phase-advance side with respect to the maximum phase-retard angular position of vane rotor 9. Additionally, the third lock hole 26 is formed as a two-stage stepped hole whose bottom face lowers stepwise from the phase-retard side to the phase-advance side. The third lock hole 26 (i.e., the two-stage stepped groove) is configured to serve as a lock guide groove.

That is, as seen in FIGS. 6-11, assuming that the inner face 1*c* of sprocket 1 is regarded as an uppermost level, the third lock guide groove (the two-stage stepped groove) 26 is configured to gradually lower from the first bottom face 26*a* to the second bottom face 26*b*, in that order. Each of inner faces, vertically extending from respective bottom faces 26*a*-26*b* on the phase-retard side, is formed as an upstanding wall surface (viewing FIGS. 6-11). The inner face 26*c*, vertically extending from the second bottom face 26*b* on the phase-advance side, is also formed as an upstanding wall surface (viewing FIGS. 6-11).

As best seen in FIGS. 2 and 6-11, the first lock pin 27 is slidably disposed in a first lock-pin hole 31*a* (an axial through hole) formed in the first large-diameter portion 15*e* of rotor 15. The first lock pin 27 is contoured as a stepped shape, comprised of the comparatively small-diameter tip 27*a*, a comparatively large-diameter cylindrical-hollow basal portion 27*b* integrally formed continuously with the rear end of small-diameter tip 27*a*, and a stepped pressure-receiving surface 27*c* defined between the tip 27*a* and the large-diameter cylindrical-hollow basal portion 27*b*. The end face of tip 27*a* is formed as a flat face, which can be brought into abutted-engagement (exactly, into wall-contact) with each of bottom faces 24*a* and 24*b*.

The first lock pin 27 is permanently biased in a direction of movement of first lock pin 27 into engagement with the first lock hole 24 by a spring force of a first spring 36 (a first biasing member or first biasing means). The first spring 36 is disposed between the bottom face of an axial spring bore formed in the large-diameter cylindrical-hollow basal portion 27*b* in a manner so as to axially extend from the rear end face and the inner wall surface of front cover 13 under preload.

The first lock pin 27 is also configured such that hydraulic pressure from a first unlocking pressure-receiving chamber 32, which chamber is formed in the rotor 15, is applied to the stepped pressure-receiving surface 27*c*. The applied hydraulic pressure causes a backward movement of first lock pin 27 against the spring force of first spring 36, and thus the first lock pin 27 is disengaged from the first lock hole 24.

In a similar manner to the first lock pin 27, the second lock pin 28 is slidably disposed in a second lock-pin hole 31*b* (an axial through hole) formed in the first large-diameter portion 15*e* of rotor 15. The second lock pin 28 is contoured as a stepped shape, comprised of the comparatively small-diameter tip 28*a*, a comparatively large-diameter cylindrical-hollow basal portion 28*b* integrally formed continuously with the rear end of small-diameter tip 28*a*, and a stepped pressure-receiving surface 28*c* defined between the tip 28*a* and the large-diameter cylindrical-hollow basal portion 28*b*. The end face of tip 28*a* is formed as a flat face, which can be brought into abutted-engagement (exactly, into wall-contact) with each of bottom faces 25*a* and 25*b*.

The second lock pin 28 is permanently biased in a direction of movement of second lock pin 28 into engagement with the second lock hole 25 by a spring force of a second spring 37 (a second biasing member or second biasing means). The second spring 37 is disposed between the bottom face of an axial spring bore formed in the large-diameter cylindrical-hollow basal portion 28*b* in a manner so as to axially extend from the rear end face and the inner wall surface of front cover 13 under preload.

The second lock pin 28 is also configured such that hydraulic pressure from a second unlocking pressure-receiving chamber 33, which chamber is formed in the rotor 15, is applied to the stepped pressure-receiving surface 28*c*. The applied hydraulic pressure causes a backward movement of second lock pin 28 against the spring force of second spring 37, and thus the second lock pin 28 is disengaged from the second lock hole 25.

The third lock pin 29 is slidably disposed in a third lock-pin hole 31*c* (an axial through hole) formed in the second large-diameter portion 15*f* of rotor 15. The third lock pin 29 is contoured as a stepped shape, comprised of the comparatively small-diameter tip 29*a*, a comparatively large-diameter cylindrical-hollow basal portion 29*b* integrally formed continuously with the rear end of small-diameter tip 29*a*, and a stepped pressure-receiving surface 29*c* defined between the tip 29*a* and the large-diameter cylindrical-hollow basal portion 29*b*. The end face of tip 29*a* is formed as a flat face, which can be brought into abutted-engagement (exactly, into wall-contact) with the bottom face 26*a*.

The third lock pin 29 is permanently biased in a direction of movement of third lock pin 29 into engagement with the third lock hole 26 by a spring force of a third spring 38 (a third biasing member or third biasing means). The third spring 38 is disposed between the bottom face of an axial spring bore formed in the large-diameter cylindrical-hollow basal portion 29*b* in a manner so as to axially extend from the rear end face and the inner wall surface of front cover 13 under preload.

The third lock pin 29 is also configured such that hydraulic pressure from a third unlocking pressure-receiving chamber 34, which chamber is formed in the rotor 15, is applied to the stepped pressure-receiving surface 29*c*. The applied hydraulic pressure causes a backward movement of third lock pin 29 against the spring force of third spring 38, and thus the third lock pin 29 is disengaged from the third lock hole 26.

The relative-position relationship of first, second, and third lock holes 24-26 formed in the inner face 1*c* of sprocket 1 and first, second, and third lock pins 27-29 located and installed in the rotor 15 is as follows.

Figure 6:
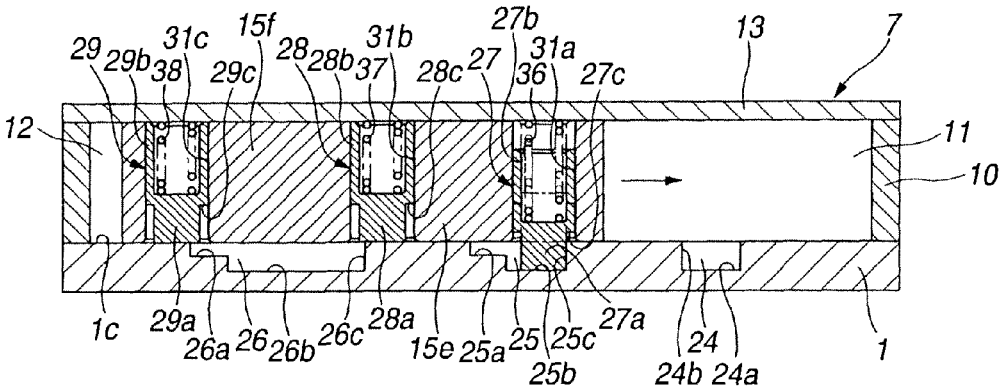
FIG. 6 is a development cross-sectional view illustrating an operation of each of lock pins with the vane rotor held at the maximum phase-retard position.

That is, as seen in FIG. 6, when vane rotor 9 has rotated relative to sprocket 1 and reached the maximum phase-retard position, the first lock pin 27 is brought into engagement with the second lock hole 25, and thus the axial end face of the tip 27*a* of first lock pin 27 is brought into abutted-engagement with the second bottom face 25*b* of second lock hole 25 and simultaneously the outer periphery (the edge) of the tip 27*a* of first lock pin 27 is also brought into abutted-engagement with the phase-advance side upstanding inner face 25*c*.

Thereafter, with the first lock pin 27 sliding out of engagement with the second lock hole 25, suppose that vane rotor 9 somewhat rotates in the phase-advance direction from the maximum phase-retard position. In a phase wherein the third lock pin 29 is brought into engagement with the first bottom face 26*a* of third lock hole 26 (see FIG. 7), and in a phase just after the third lock pin 29 has been brought into engagement with the second bottom face 26*b* (see FIG. 8), the axial end face of the tip 27*a* of first lock pin 27 and the axial end face of the tip 28*a* of second lock pin 28 are still kept in abutted-engagement with the inner face 1*c* of sprocket 1.

Figure 9:
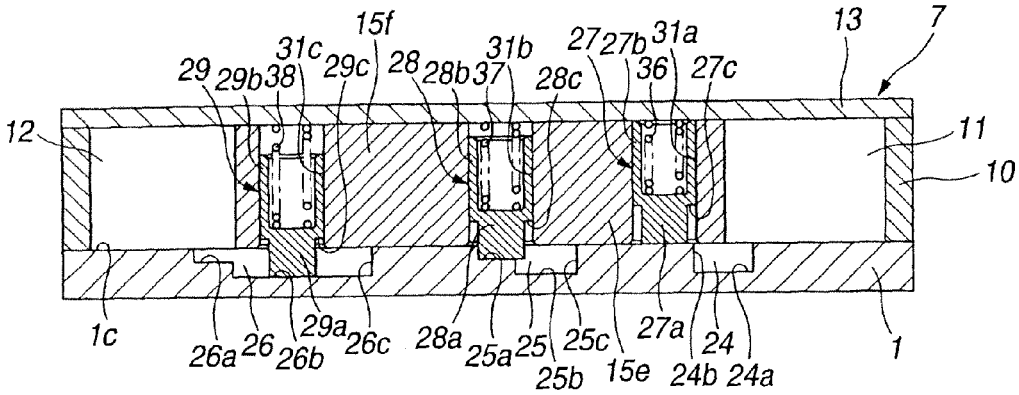
FIG. 9 is a development cross-sectional view illustrating a still further operation of each of the lock pins with the vane rotor further rotated from the angular position of FIG. 8 to the phase-advance side.

Thereafter, as seen in FIG. 9, when, owing to a slight rotary motion of vane rotor 9 in the phase-advance direction, the axial end face of the tip 29*a* of third lock pin 29 slides along the second bottom face 26*b* of third lock hole 26 and then reaches a substantially midpoint of the second bottom face 26*b*, the tip 28*a* of second lock pin 28 is brought into abutted-engagement with the first bottom face 25*a* of second lock hole 25.

Figure 10:
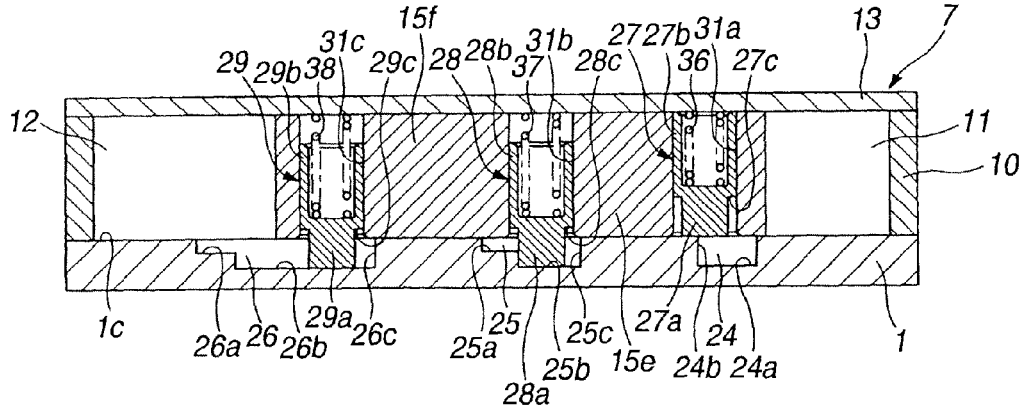
FIG. 10 is a development cross-sectional view illustrating another operation of each of the lock pins with the vane rotor further rotated from the angular position of FIG. 9 to the phase-advance side.

As seen in FIG. 10, when the tip 29*a* of third lock pin 29 further moves in the phase-advance direction, while being kept in sliding-contact with the second bottom face 26*b*, the tip 28*a* of second lock pin 28 slides out of engagement with the first bottom face 25*a* of second lock hole 25 but slides into abutted-engagement with the second bottom face 25*b*. At this time, the axial end face of the tip 27*a* of first lock pin 27 slides in the phase-advance direction, while being still kept in abutted-engagement with the inner face 1*c* of sprocket 1.

Figure 11:
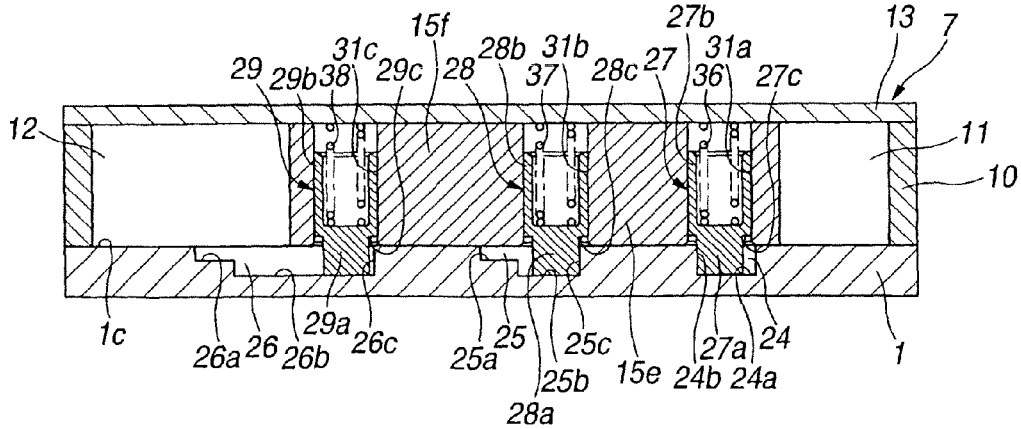
FIG. 11 is a development cross-sectional view illustrating a further operation of each of the lock pins with the vane rotor further rotated from the angular position of FIG. 10 to the phase-advance side.

Thereafter, when, owing to a further rotary motion of vane rotor 9 in the phase-advance direction, the second lock pin 28 kept in abutted-engagement with the second bottom face 25*b* and the third lock pin 29 kept in abutted-engagement with the second bottom face 26*b* further move in the same phase-advance direction, the tip 27*a* of first lock pin 27 slides into engagement with the first lock hole 24 (see FIG. 11). In this manner, the relative-position relationship among first, second and third lock holes 24-26 and first, second and third lock pins 27-29 is preset. With three lock pins 27-29 engaged with respective lock holes 24-26, the circumferentially-opposed outer peripheral edges of first and second lock pins 27-28, circumferentially opposed to each other, abut with the circumferentially-opposed upstanding inner faces 24*b* and 25*c* of first and second lock holes 24-25, respectively, such that the specified area of the inner face 1*c* of sprocket 1, ranging between the two upstanding inner faces 24*b* and 25*c*, is sandwiched with the two lock pins 27-28.

At this time, as best seen in FIG. 11, a further movement of third lock pin 29 in the phase-advance direction is restricted by a combined locking action of first and second lock pins 27-28 (that is, by abutment of the outer periphery (the edge) of the tip 27*a* of first lock pin 27 with the upstanding inner face 24*b* and by abutment of the outer periphery (the edge) of the tip 28*a* of second lock pin 28 with the upstanding inner face 25*c*) under a specified state where the outer periphery of the tip 29*a* of third lock pin 29 is slightly spaced apart from the upstanding inner face 26*c* vertically extending from the second bottom face 26*b*.

Briefly speaking, as can be seen from the cross sections of FIGS. 6-11, according to rotary motion of vane rotor 9 relative to sprocket 1 from the phase-retard position toward the phase-advance position, the third lock pin 29 is brought into abutted-engagement with the first and second bottom faces 26*a*-26*b*, one-by-one (in a stepwise manner) and further moves in the phase-advance direction, while being kept in sliding-contact with the second bottom face 26*b*. From the middle of sliding movement of the tip 29*a* of third lock pin 29 along the second bottom face 26*b*, the second lock pin 28 slides into engagement with the second lock hole 25 and then brought into abutted-engagement with the first and second bottom faces 25*a*-25*b*, one-by-one (in a stepwise manner). Thereafter, the first lock pin 27 is sequentially brought into engagement with the first lock hole 24. As discussed above, the third and second lock guide groove structures (i.e., third and second holes 26-25) and the first lock hole 24 permit normal rotation of vane rotor 9 relative to sprocket 1 in the phase-advance direction, but restrict or prevent reverse-rotation (counter-rotation) of vane rotor 9 relative to sprocket 1 in the phase-retard direction by virtue of a five-stage ratchet action in total. Finally, the angular position of vane rotor 9 relative to sprocket 1 is held or locked at the intermediate-phase angular position (see FIG. 4) between the maximum phase-retard angular position (see FIG. 3) and the maximum phase-advance angular position (see FIG. 5).

Returning to FIG. 1, the rear end of each of first, second, and third lock-pin holes 31*a*-31*c* is configured to be opened to the atmosphere via a breather 39, thereby ensuring a smooth sliding movement of each of lock pins 27, 28 and 29.

As shown in FIG. 1, hydraulic circuit 5 includes a phase-retard passage 18, a phase-advance passage 19, lock passage 20, an oil pump 40 (serving as a fluid-pressure supply source), and a single electromagnetic directional control valve 41. Phase-retard passage 18 is provided for fluid-pressure supply-and-exhaust for each of phase-retard chambers 11 via the first communication hole 11*c*. Phase-advance passage 19 is provided for fluid-pressure supply-and-exhaust for each of phase-advance chambers 12 via the second communication hole 12*c*. Lock passage 20 is provided for fluid-pressure supply-and-exhaust for each of first, second, and third unlocking pressure-receiving chambers 32-34. Oil pump 40 is provided for supplying working fluid pressure to at least one of phase-retard passage 18 and phase-advance passage 19, and also provided for supplying working fluid pressure to lock passage 20. Single electromagnetic directional control valve 41 is provided for switching between phase-retard passage 18 and phase-advance passage 19, and also provided for switching between working-fluid supply to lock passage 20 and working-fluid exhaust from lock passage 20.

One end of phase-retard passage 18 and one end of phase-advance passage 19 are connected to respective ports (not shown) of electromagnetic directional control valve 41. The other end of phase-retard passage 18 is configured to communicate with each of phase-retard chambers 11 via an axial passage portion 18*a* formed in the camshaft 2 and the first communication hole 11*c* formed in the rotor 15. The other end of phase-advance passage 19 is configured to communicate with each of phase-advance chambers 12 via an axially-extending but partly-radially-bent passage portion 19*a* formed in the camshaft 2 and the second communication hole 12*c* formed in the rotor 15.

As shown in FIGS. 1-2, one end of lock passage 20 is connected to a lock port (not shown) of electromagnetic directional control valve 41. The other end of lock passage 20, serving as a fluid-passage portion 20*a*, is formed in the camshaft to be bent from the radial direction to the axial direction. The fluid-passage portion 20*a* of lock passage 20 is configured to communicate with respective unlocking pressure-receiving chambers 32-34 via branch oil holes 20*b*-20*c* formed in the rotor 15 and branching away.

In the shown embodiment, an internal gear rotary pump, such as a trochoid pump having inner and outer rotors, is used as the oil pump 40 driven by the engine crankshaft. During operation of oil pump 40, when the inner rotor is driven, the outer rotor also rotates in the same rotational direction as the inner rotor by mesh between the outer-rotor inner-toothed portion and the inner-rotor outer-toothed portion. Working fluid in an oil pan 42 is introduced through a suction passage into the pump, and then discharged through a discharge passage 40*a*. Part of working fluid discharged from oil pump 40 is delivered through a main oil gallery M/G to sliding or moving engine parts. The remaining working fluid discharged from oil pump 40 is delivered to electromagnetic directional control valve 41. An oil filter (not shown) is disposed in the downstream side of discharge passage 40*a*. Also, a flow control valve (not shown) is provided to appropriately control an amount of working fluid discharged from oil pump 40 into discharge passage 40*a*, thus enabling surplus working fluid discharged from oil pump 40 to be directed via a drain passage 43 to the oil pan 42.

As seen in FIG. 1, electromagnetic directional control valve 41 is an electromagnetic-solenoid operated, five-port, six-position, spring-offset, proportional control valve. Electromagnetic directional control valve 41 is comprised of a substantially cylindrical-hollow, axially-elongated valve body (a valve housing), a valve spool (an electrically-actuated valve element) slidably installed in the valve body in a manner so as to axially slide in a very close-fitting bore of the valve body, a valve spring installed inside of one axial end of the valve body for permanently biasing the valve spool in an axial direction, and an electromagnetic solenoid attached to the valve body so as to cause axial sliding movement of the valve spool against the spring force of the valve spring.

Electromagnetic directional control valve 41 is configured to move the valve spool to either one of six axial positions by the two opposing pressing forces, produced by a spring force of the valve spring and a control current generated from a controller 35 and flowing through the electromagnetic solenoid coil, so as to change a state of fluid-communication between the discharge passage 40*a* of oil pump 40 and each of three passages (that is, phase-retard passage 18, phase-advance passage 19, and lock passage 20) and simultaneously change a state of fluid-communication between the drain passage 43 and each of the three passages 18, 19, and 20, depending on a selected one of the six positions of the valve spool.

As discussed above, electromagnetic directional control valve 41 is configured to change the path of flow through the directional control valve 41 by selective switching among the ports depending on a given axial position of the valve spool, determined based on latest up-to-date information about an engine operating condition (e.g., engine speed and engine load), thereby changing a relative angular phase of vane rotor 9 (camshaft 2) to sprocket 1 (the crankshaft) and also enabling selective switching between locked and unlocked states of lock mechanism 4, in other words, selective switching between a locked (engaged) state of lock pins 27-29 with respective lock holes 24-26 and an unlocked (disengaged) state of lock pins 27-29 from respective lock holes 24-26. Accordingly, by means of electromagnetic directional control valve 41 as previously discussed, free rotation of vane rotor 9 relative to sprocket 1 can be enabled (permitted) or disabled (restricted) depending on the engine operating condition.

Controller (ECU) 35 generally comprises a microcomputer. Controller 35 includes an input/output interface (I/O), memories (RAM, ROM), and a microprocessor or a central processing unit (CPU). The input/output interface (I/O) of controller 35 receives input information from various engine/vehicle switches and sensors, namely a crank angle sensor (a crank position sensor), an airflow meter, an engine temperature sensor (e.g., an engine coolant temperature sensor), a throttle opening sensor (a throttle position sensor), a cam angle sensor, an oil-pump discharge pressure sensor, and the like. The crank angle sensor is provided for detecting revolution speeds of the engine crankshaft and for calculating an engine speed. The airflow meter is provided for generating an intake-air flow rate signal indicating an actual intake-air flow rate or an actual air quantity. The engine temperature sensor is provided for detecting an actual operating temperature of the engine. The cam angle sensor is provided for detecting latest up-to-date information about an angular phase of camshaft 2. The discharge pressure sensor is provided for detecting a discharge pressure of working fluid discharged from the oil pump 40. Within controller 35, the central processing unit (CPU) allows the access by the I/O interface of input informational data signals from the previously-discussed engine/vehicle switches and sensors, so as to detect the current engine operating condition, and also to generate a control pulse current, determined based on latest up-to-date information about the detected engine operating condition and the detected discharge pressure, to the electromagnetic coil of the solenoid of electromagnetic directional control valve 41, for controlling the axial position of the sliding valve spool, thus achieving selective switching among the ports depending on the controlled axial position of the valve spool.

As hereunder described in detail, output control for pulse current, applied to electromagnetic directional control valve 41, is classified into a so-called manual-engine-stop pulse-current output control, executed when the engine is stopped by manually turning the ignition switch OFF, and a so-called automatic-engine-stop pulse-current output control, executed when the engine is automatically temporarily stopped by means of an idling-stop system, for instance in accordance with idle-reduction (idle-stop) action.

Operation of Valve Timing Control Apparatus of Embodiment

Details of operation of the valve timing control apparatus of the embodiment are hereunder described.

Manual-Engine-Stop

For instance, when an ignition switch has been turned OFF after normal vehicle traveling and thus the engine has stopped rotating, a supply of control current from controller 35 to the electromagnetic coil of electromagnetic directional control valve 41 is stopped and thus the solenoid is de-energized. Thus, the valve spool is positioned at the maximum rightward axial position (i.e., the "first position", in other words, the spring-loaded or spring-offset position) by the spring force of the valve spring. Hence, the discharge passage 40*a* communicates with both of the phase-retard passage 18 and the phase-advance passage 19, whereas the lock passage 20 communicates with the drain passage 43.

At the same time, oil pump 40 is placed into an inoperative state, and thus working-fluid supply to phase-retard chamber 11 or phase-advance chamber 12 becomes stopped, and also working-fluid supply to each of first, second, and third unlocking pressure-receiving chambers 32-34 becomes stopped.

That is, during idling before the engine is brought into a stopped state, vane rotor 9 is placed into the maximum phase-retard angular position shown in FIG. 3 by the working-fluid pressure supply to each of phase-retard chambers 11. At this time, as seen in FIG. 6, the second and third lock pins 28-29 are kept out of engagement with the respective lock holes 25-26 but kept in abutted-engagement with the inner face 1*c* of sprocket 1 under preload. On the other hand, the first lock pin 27 is kept in engagement with the second lock hole 25.

Under these conditions, when the ignition switch becomes manually turned OFF, there is a pulse current output to the solenoid of electromagnetic directional control valve 41 immediately before the engine stops during the initial part of turning-OFF action of the ignition switch, and thus there is a working-fluid supply from oil pump 40 to each of unlocking pressure-receiving chambers 32-34 responsively to the pulse current output. Hence, as indicated by the one-dotted line in FIG. 6, a backward movement of first lock pin 27 against the spring force of first spring 36 occurs. As a result, the first lock pin 27 slides out of engagement with the second lock hole 25.

Also, immediately before the engine stops, alternating torque, acting on camshaft 2, occurs. In particular, when rotary motion of vane rotor 9 relative to sprocket 1 in the phase-advance direction occurs owing to the negative torque of alternating torque acting on camshaft 2 and thus the angular position of vane rotor 9 relative to sprocket 1 reaches the intermediate-phase angular position (see FIG. 4), the tip 27*a* of first lock pin 27, the tip 28*a* of second lock pin 28, and the tip 29*a* of third lock pin 29 are brought into engagement with respective lock holes 24-26 by the spring forces of first, second, and third springs 36-38 (see FIG. 11). As a result of this, the angular position of vane rotor 9 relative to sprocket 1 is held or locked at the intermediate-phase angular position (see FIG. 4) between the maximum phase-retard angular position (see FIG. 3) and the maximum phase-advance angular position (see FIG. 5).

Figure 7:
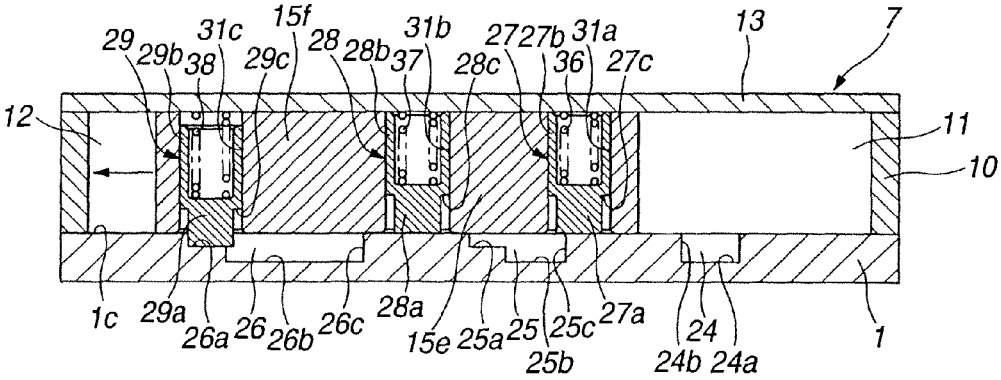
FIG. 7 is a development cross-sectional view illustrating another operation of each of the lock pins with the vane rotor slightly rotated from the maximum phase-retard position to the phase-advance side owing to alternating torque.

More concretely, at a point of time when a slight rotary motion of vane rotor 9 relative to sprocket 1 in the phase-advance direction (see the direction indicated by the arrow in FIG. 6) from the angular position of FIG. 6 to the angular position of FIG. 7 occurs owing to the negative torque of alternating torque acting on camshaft 2, a pulse current output from controller 35 to the electromagnetic coil of electromagnetic directional control valve 41 is stopped, and thus a working-fluid supply from oil pump 40 to each of unlocking pressure-receiving chambers 32-34 is also stopped.

Thus, as seen in FIG. 7, the tip 27*a* of first lock pin 27 is kept in abutted-engagement with the inner face 1*c* of sprocket 1 under preload (by the spring force of first spring 36), and the tip 29*a* of third lock pin 29 is brought into abutted-engagement with the first bottom face 26*a* of third lock hole 26 by the spring force of third spring 38. At this time, even when vane rotor 9 tends to rotate relative to sprocket 1 in the opposite direction (i.e., in the phase-retard direction) owing to the positive torque of alternating torque acting on camshaft 2, such a rotary motion of vane rotor 9 in the phase-retard direction (see the direction indicated by the arrow in FIG. 7) can be restricted by abutment of the outer periphery (the edge) of the tip 29*a* of third lock pin 29 with the upstanding stepped inner face vertically extending from the first bottom face 26*a*.

Figure 8:
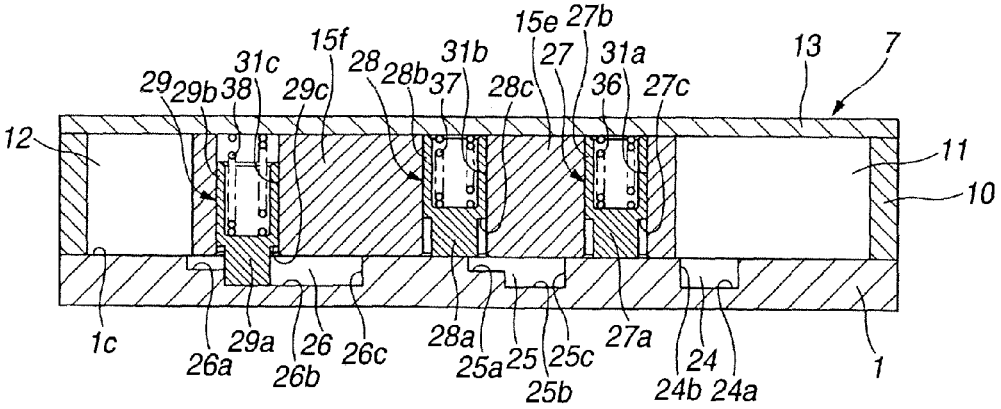
FIG. 8 is a development cross-sectional view illustrating a further operation of each of the lock pins with the vane rotor further rotated from the angular position of FIG. 7 to the phase-advance side.

Thereafter, when a further rotary motion of vane rotor 9 relative to sprocket 1 in the phase-advance direction occurs owing to the negative torque acting on camshaft 2, as shown in FIGS. 7-8, third lock pin 29 lowers from the first bottom face 29*a* to the second bottom face 29*b* stepwise in the phase-advance direction and thus the tip 29*a* of third lock pin 29 is brought into abutted-engagement with the second bottom face 26*b*. Then, by virtue of the ratchet action, the tip 29*a* of third lock pin 29 moves along the second bottom face 26*b* in the phase-advance direction, and then reaches a substantially midpoint of the second bottom face 26*b*. At this time, as shown in FIG. 9, the tip 28*a* of second lock pin 28 slides into abutted-engagement with the first bottom face 25*a* of second lock hole 25 by the spring force of second spring 37. Thereafter, when vane rotor 9 further rotates in the phase-advance direction, as shown in FIGS. 9-10, the tip 29*a* of third lock pin 29 moves to the vicinity of the upstanding inner face 26*c* of third lock hole 26. At the same time, the tip 28*a* of second lock pin 28 is brought into abutted-engagement with the second bottom face 25*b* by virtue of the ratchet action.

When vane rotor 9 still further rotates in the phase-advance direction owing to the negative torque, as shown in FIGS. 10-11, the tip 27*a* of first lock pin 27 slides into engagement with the first lock hole 24, while second and third lock pins 28-29 slide in the same direction. Under these conditions, as previously discussed, the circumferentially-opposed outer peripheral edges of first and second lock pins 27-28, circumferentially opposed to each other, abut with the circumferentially-opposed upstanding inner faces 24*b* and 25*c* of first and second lock holes 24-25, respectively, such that the specified area of the inner face 1*c* of sprocket 1, ranging between the two upstanding inner faces 24*b* and 25*c*, is sandwiched with the two lock pins 27-28. Hence, vane rotor 9 can be stably surely held or locked at the intermediate-phase angular position (see FIG. 4) between the maximum phase-retard angular position and the maximum phase-advance angular position.

Thereafter, immediately after the ignition switch has been turned ON to start up the engine, due to initial explosion (the start of cranking) oil pump 40 begins to operate. Thus, the discharge pressure of working fluid discharged from oil pump 40 is delivered to each phase-retard chamber 11 and each phase-advance chamber 12 via respective passages 18 and 19. On the other hand, the lock passage 20 is kept in a fluid-communication relationship with the drain passage 43. Thus, first, second, and third lock pins 27-29 are kept in engagement with respective lock holes 24-26 by the spring forces of first, second, and third springs 36-38.

As previously discussed, the axial position of the valve spool of electromagnetic directional control valve 41 is controlled by means of controller 35 depending on latest up-to-date information about the detected engine operating condition and the detected pump discharge pressure. Hence, with the engine at an idle rpm, at which the discharge pressure of working fluid discharged from oil pump 40 is unstable, the engaged states (locked states) of first, second, and third lock pins 27-29 are maintained.

After this, immediately before the engine operating condition shifts from the idling condition to a low-speed low-load operating range or a high-speed high-load operating range, a control current is outputted from controller 35 to the electromagnetic coil of electromagnetic directional control valve 41. Thus, the valve spool is slightly displaced against the spring force of the valve spring. The, axial position of the valve spool, slightly displaced from the "first position" (the spring-offset position) is referred to as "sixth position". With the valve spool held at the "sixth position", fluid communication between the discharge passage 40*a* and the lock passage 20 becomes established. On the other hand, both of the phase-retard passage 18 and the phase-advance passage 19 remain kept in a fluid-communication relationship with the discharge passage 40*a*.

Therefore, working fluid can be supplied via the fluid-passage portion 20*a* of lock passage 20 to each of first, second, and third unlocking pressure-receiving chambers 32-34. Hence, movement of the tip 27*a* of first lock pin 27 out of engagement with the first lock hole 24 against the spring force of first spring 36, movement of the tip 28*a* of second lock pin 28 out of engagement with the second lock hole 25 against the spring force of second spring 37, and movement of the tip 29*a* of third lock pin 29 out of engagement with the third lock hole 26 against the spring force of third spring 38 simultaneously occur. Thus, free rotation of vane rotor 9 relative to sprocket 1 in the normal-rotational direction or in the reverse-rotational direction can be permitted. At the same time, working fluid is supplied to both of the phase-retard chamber 11 and the phase-advance chamber 12.

Hereupon, assume that working-fluid pressure is merely delivered to either one of phase-retard chamber 11 and phase-advance chamber 12. In such a case, a rotary motion of vane rotor 9 relative to sprocket 1 in either one of the phase-retard direction and the phase-advance direction occurs, and hence the first lock pin 27 has to receive a shearing force caused by a circumferential displacement of the first lock-pin hole 31*a* of rotor 15 relative to the first lock hole 24. In a similar manner, the second lock pin 28 has to receive a shearing force caused by a circumferential displacement of the second lock-pin hole 31*b* of rotor 15 relative to the second lock hole 25. In a similar manner, the third lock pin 29 has to receive a shearing force caused by a circumferential displacement of the third lock-pin hole 31*c* of rotor 15 relative to the third lock hole 26. As a result of this, the first lock pin 27 is brought into a so-called jammed (bitten) condition between the first lock-pin hole 31*a* and the first lock hole 24 displaced relatively. The second lock pin 28 is also brought into a so-called jammed (bitten) condition between the second lock-pin hole 31*b* and the second lock hole 25 displaced relatively. The third lock pin 29 is also brought into a so-called jammed (bitten) condition between the third lock-pin hole 31*c* and the third lock hole 26 displaced relatively. Hence, there is a possibility that the locked (engaged) state of lock pins 27-29 with respective lock holes 24-26 cannot be easily released.

Also, assume that there is no hydraulic-pressure supply to both of the phase-retard chamber 11 and the phase-advance chamber 12. In such a case, owing to alternating torque transmitted from the camshaft 2, vane rotor 9 tends to flutter, and thus vane rotor 9 (especially, the first vane 16*a*) is brought into collision-contact with the shoe 10*a* of housing body 10, and whereby there is an increased tendency for hammering noise to occur.

In contrast to the above, according to the valve timing control apparatus of the embodiment, working-fluid pressure (hydraulic pressure) can be simultaneously supplied to both of the phase-retard chamber 11 and the phase-advance chamber 12. Thus, it is possible to adequately suppress vane rotor 9 from fluttering and also to adequately suppress the jammed (bitten) condition of the first lock pin 27 between the first lock-pin hole 31*a* and the first lock hole 24, the jammed (bitten) condition of the second lock pin 28 between the second lock-pin hole 31*b* and the second lock hole 25, and the jammed (bitten) condition of the third lock pin 29 between the third lock-pin hole 31*c* and the third lock hole 26.

Thereafter, when the engine operating condition has been shifted to a low-speed low-load operating range, the valve spool is further displaced against the spring force of the valve spring by energizing the solenoid with a further increase in electric current flowing through the electromagnetic coil of electromagnetic directional control valve 41, and thus positioned at the "third position". Both of the lock passage 20 and the phase-retard passage 18 remain kept in a fluid-communication relationship with the discharge passage 40*a*. Fluid-communication between the phase-advance passage 19 and the drain passage 43 becomes established.

As a result of this, first, second, and third lock pins 27-29 become kept out of engagement with respective lock holes 24-26. Also, working fluid in phase-advance chamber 12 is drained through the drain passage 43 and thus hydraulic pressure in phase-advance chamber 12 becomes low, whereas working fluid is delivered via the discharge passage 40*a* to the phase-retard chamber 11 and thus hydraulic pressure in phase-retard chamber 11 becomes high. Accordingly, vane rotor 9 rotates relative to the housing 7 (i.e., sprocket 1) toward the maximum phase-retard angular position.

Accordingly, a valve overlap of open periods of intake and exhaust valves becomes small and thus the amount of in-cylinder residual gas also reduces, thereby enhancing a combustion efficiency and consequently ensuring stable engine revolutions and improved fuel economy.

Thereafter, when the engine operating condition has been shifted to a high-speed high-load operating range, the valve spool is displaced by energizing the solenoid of electromagnetic directional control valve 41 with a small amount of control current flowing through the electromagnetic coil, and thus positioned at the "second position". As a result, fluid-communication between the phase-retard passage 18 and the drain passage 43 becomes established. The lock passage 20 remains kept in a fluid-communication relationship with the discharge passage 40*a*. At the same time, fluid-communication between the phase-advance passage 19 and the discharge passage 40*a* becomes established.

Therefore, first, second, and third lock pins 27-29 are kept out of engagement with respective lock holes 24-26. Also, working fluid in phase-retard chamber 11 is drained through the drain passage 43 and thus hydraulic pressure in phase-retard chamber 11 becomes low, whereas working fluid is delivered via the discharge passage 40*a* to the phase-advance chamber 12 and thus hydraulic pressure in phase-advance chamber 12 becomes high. Accordingly, vane rotor 9 rotates relative to the housing 7 (i.e., sprocket 1) toward the maximum phase-advance angular position (see FIG. 5). Thus, the angular phase of camshaft 2 relative to sprocket 1 is converted into the maximum advanced relative-rotation phase.

Accordingly, a valve overlap of open periods of intake and exhaust valves becomes large and thus the intake-air charging efficiency is increased, thereby improving engine torque output.

Conversely when the engine operating condition shifts from the low-speed low-load operating range or the high-speed high-load operating range to the idling condition, a supply of control current from controller 35 to the electromagnetic coil of electromagnetic directional control valve 41 is stopped and thus the solenoid is de-energized. Thus, the valve spool is positioned at the "first position" (i.e., the spring-offset position) shown in FIG. 1 by the spring force of the valve spring. The lock passage 20 communicates with the drain passage 43, whereas the discharge passage 40*a* communicates with both of the phase-retard passage 18 and the phase-advance passage 19. Accordingly, hydraulic pressures having almost the same pressure value are applied to respective hydraulic chambers (phase-retard chamber 11 and phase-advance chamber 12).

For the reasons discussed above, even when vane rotor 9 has been positioned at a phase-retard angular position, rotary motion of vane rotor 9 relative to sprocket 1 in the phase-advance direction occurs owing to alternating torque acting on camshaft 2. Hence, by the spring force of first spring 36 and by virtue of the ratchet action of the first lock guide groove (bottom face 24*a*), first lock pin 27 is brought into engagement with the bottom face 24*a* of first lock hole 24, owing to rotary motion of vane rotor 9 in the phase-advance direction. In a similar manner, by the spring force of second spring 37 and by virtue of the ratchet action of the second lock guide stepped groove (bottom faces 25*a*-25*b*), second lock pin 28 is brought into engagement with the first and second bottom faces 25*a*-25*b* of second lock hole 25, one-by-one, owing to rotary motion of vane rotor 9 in the phase-advance direction. Also, by the spring force of third spring 38 and by virtue of the ratchet action of the third lock guide stepped groove (bottom faces 26*a*-26*b*), third lock pin 29 is brought into engagement with the first and second bottom faces 26*a*-26*b* of third lock hole 26, one-by-one, owing to rotary motion of vane rotor 9 in the phase-advance direction. Hence, the angular position of vane rotor 9 relative to sprocket 1 is held or locked at the intermediate-phase angular position (see FIG. 4) between the maximum phase-retard angular position and the maximum phase-advance angular position.

Also, when manually stopping the engine, the ignition switch is turned OFF. As previously described, first, second, and third lock pins 27-29 are maintained in their locked states where the tip 27*a* of first lock pin 27 has been engaged with the bottom face 24*a* of first lock hole 24, the tip 28*a* of second lock pin 28 has been engaged with the second bottom face 25*b* of second lock hole 25, and the tip 29*a* of third lock pin 29 has been engaged with the second bottom face 26*b* of third lock hole 26.

Furthermore, assume that the engine is operating continuously in a given engine operating range, the electromagnetic coil of the solenoid of electromagnetic directional control valve 41 is energized with a given amount of control current, and thus the valve spool is positioned at a substantially intermediate axial position, that is, the "fourth position". As a result, fluid communication between the phase-advance passage 19 and the discharge passage 40*a* is blocked and fluid communication between the phase-retard passage 18 and the drain passage 43 is blocked. On the other hand, fluid communication between the discharge passage 40*a* and the lock passage 20 is established. Hence, hydraulic pressure of working fluid in each of phase-retard chambers 11 and hydraulic pressure of working fluid in each of phase-advance chambers 12 are held constant. Also, by the hydraulic-pressure supply from the discharge passage 40*a* to the lock passage 20, first, second, and third lock pins 27-29 are kept out of engagement with respective lock holes 24-26, that is, held in their unlocked states.

Therefore, the angular position of vane rotor 9 relative to sprocket 1 is held at a desired angular position corresponding to the given amount of control current, and thus the angular phase of camshaft 2 relative to sprocket 1 (i.e., housing 7) is held at a desired relative-rotation phase. Accordingly, intake valve open timing (IVO) and intake valve closure timing (IVC) can be held at respective desired timing values.

In this manner, by energizing the solenoid of electromagnetic directional control valve 41 with a desired amount of control current or de-energizing the solenoid, by means of controller 35 depending on latest up-to-date information about an engine operating condition, and thus controlling axial movement of the valve spool, the axial position of the valve spool can be controlled to either one of the first, second, third, and fourth positions. As discussed above, the angular phase of camshaft 2 relative to sprocket 1 (i.e., housing 7) can be adjusted or controlled to a desired relative-rotation phase (an optimal relative-rotation phase) by controlling both of the phase-change mechanism 3 and the lock mechanism 4, thus more certainly enhancing the control accuracy of valve timing control.

Moreover, assume that the axially sliding spool of the energized electromagnetic directional control valve 41 has been stuck due to contamination, dirt or debris (e.g., a very small piece of metal) contained in working fluid used in the hydraulic circuit 5 and jammed between the edge of each of land portions of the spool and the edge of each of the ports, when the engine has stopped abnormally due to an undesirable engine stall, or when restarting the engine after the engine has stopped normally. Owing to the sticking spool, it is difficult to achieve selective switching among the ports, that is, a change in the path of flow through the electromagnetic directional control valve 41. Under such an abnormal condition, that is, under a disabling state of sliding movement of the valve spool, the control valve system of the embodiment operates as follows.

That is, when, due to the sticking valve spool, the valve spool is in the disabling state of sliding movement, as a matter of course, it is impossible to execute angular phase control of vane rotor 9. The abnormal condition (i.e., the disabling state of movement of the valve spool) is determined by controller 35, based on a result of comparison between the actual angular phase detected by the cam angle sensor and the desired angular phase of camshaft 2, in other words, based on a time duration during which a state where a command value (a desired valve timing value) for valve timing control differs from an actually detected valve timing value continues, and its predetermined threshold time duration. When the abnormal condition has been determined by means of controller 35, controller 35 generates a maximum amount of control current to the electromagnetic coil of the solenoid of electromagnetic directional control valve 41. As a result of this, the valve spool is forcibly displaced axially against the spring force of the valve spring by a maximum magnitude of electromagnetic force produced by the solenoid, while shearing the contamination or debris, and thus positioned at the "fifth position". Hence, all of phase-retard passage 18, phase-advance passage 19, and lock passage 20 communicate with the drain passage 43, and as a result working fluid in each of phase-retard chambers 11, working fluid in each of phase-advance chambers 12, and working fluid in each of first, second, and third unlocking pressure-receiving chambers 32-34 are all drained into the oil pan 42. As discussed above, electromagnetic directional control valve 41 has six different envelope configurations. In FIG. 1, the rightmost envelope configuration of electromagnetic directional control valve 41 corresponds to the "first position", whereas the leftmost envelope configuration corresponds to the "fifth position". That is, the rightmost envelope configuration corresponding to the "first position", the envelope configuration corresponding to the "sixth position", the envelope configuration corresponding to the "third position", the envelope configuration corresponding to the "fourth position", the envelope configuration corresponding to the "second position", and the leftmost envelope configuration corresponding to the "fifth position" are arranged in that order in the right-to-left direction.

Automatic-Engine-Stop

When the engine is automatically stopped by means of an idling-stop system, in a similar manner to the previously-discussed manual-engine-stop operation, during idling before the engine automatically stops, electromagnetic directional control valve 41 is still energized by the controller 35, so that the valve spool of electromagnetic directional control valve 41 is positioned at the "third position". Fluid-communication between the phase-retard passage 18 and the discharge passage 40*a* is established, while fluid-communication between the phase-advance passage 19 and the drain passage 43 is established. At the same time, fluid-communication between the lock passage 20 and the discharge passage 40*a* is established. Therefore, first, second, and third lock pins 27-29 are kept at their retracted positions under hydraulic pressure. Working fluid is delivered via the discharge passage 40*a* to the phase-retard chamber 11 and thus hydraulic pressure in phase-retard chamber 11 becomes high, whereas working fluid in phase-advance chamber 12 is drained through the drain passage 43 and thus hydraulic pressure in phase-advance chamber 12 becomes low. Hence, vane rotor 9 becomes placed into the maximum phase-retard angular position shown in FIG. 3.

Immediately when vane rotor 9 reaches the maximum phase-retard angular position shown in FIG. 3, a pulse current output from controller 35 to the electromagnetic coil of electromagnetic directional control valve 41 becomes stopped, and thus the valve spool of electromagnetic directional control valve 41 becomes positioned at the "first position" (i.e., the spring-offset position) shown in FIG. 1, so that the lock passage 20 communicates with the drain passage 43. At this time, there is no supply of working fluid from oil pump 40 to each of unlocking pressure-receiving chambers 32-34, and thus first, second, and third lock pins 27-29 are forced in their extending directions by the biasing forces of first, second, and third springs 36-38. As a result, as seen in FIG. 6, the second and third lock pins 28-29 are kept out of engagement with the respective lock holes 25-26 but kept in abutted-engagement with the inner face 1*c* of sprocket 1 under preload (by the biasing forces of second and third springs 37-38). On the other hand, the first lock pin 27 is kept in engagement with the second lock hole 25 by the biasing force of first spring 36.

Hence, vane rotor 9 can be stably surely held or locked at the maximum phase-retard angular position (see FIG. 3). Thereafter, when automatically restarting the engine, that is, at the beginning of cranking, the engine can be restarted at intake-valve timing corresponding to the maximum retarded phase. This contributes to the appropriately reduced effective compression ratio, thereby adequately suppressing noise and vibrations of the engine, while ensuring a good startability.

By the way, after the engine has been automatically restarted, in the same manner as previously discussed, electromagnetic directional control valve 41 becomes energized. Depending on the axial position of the sliding spool, fluid-communication between the discharge passage 40*a* and the lock passage 20 becomes established. Thus, movement of the tip 27*a* of first lock pin 27 out of engagement with the second lock hole 25 against the spring force of first spring 36 occurs. Thus, free rotation of vane rotor 9 relative to sprocket 1 in the normal-rotational direction or in the reverse-rotational direction can be permitted.

As discussed above, in the valve timing control apparatus of the embodiment, first, second, and third lock pins 27-29 are installed in the rotor 15 of vane rotor 9 via respective lock-pin holes 31*a*-31*c*, without installing in the vanes 16*a*-16*d* of vane rotor 9. Thus, it is possible to adequately reduce a circumferential thickness of each of vanes 16*a*-16*d*, thereby adequately enlarging a relative-rotation angle of vane rotor 9 relative to housing 7. Also, this contributes to a more compact VTC apparatus.

Hitherto, in order to retain or hold lock pins, the rotor diameter of a vane rotor (a vane member) in itself had to be expanded. In contrast, in the apparatus of the embodiment, the rotor 15 of vane rotor 9 has partly-expanded, circumferentially-spaced large-diameter portions 15*e*-15*f* without expanding the entire circumference of rotor 15, and three lock pins 27-29 are installed in the partly-expanded large-diameter portions 15*e*-15*f* of rotor 15. By virtue of the different-diameter deformed outer peripheral surface of rotor 15, the total volumetric capacity of hydraulic chambers 11*a* and 12*a*, located in the area corresponding to the small-diameter portion (each of first and second small-diameter portions 15*c*-15*d*) of rotor 15, is set to be greater than the total volumetric capacity of hydraulic chambers 11*b* and 12*b*, located in the area corresponding to the large-diameter portion (each of first and second large-diameter portions 15*e*-15*f*).

Thus, the pressure-receiving surface area of each of side faces 16*e*-16*h* of vanes 16*a*-16*d*, facing hydraulic chambers 11*a* and 12*a* located in the area corresponding to the small-diameter portion (each of first and second small-diameter portions 15*c*-15*d*), is set to be adequately greater than that of each of side faces of vanes 16*a*-16*d*, facing hydraulic chambers 11*b* and 12*b* located in the area corresponding to the large-diameter portion (each of first and second large-diameter portions 15*e*-15*f*). Hence, during valve timing control, a relative-rotation speed of vane rotor 9 to housing 7 can be increased, thereby adequately enhancing a conversion responsiveness of the relative-rotation phase of camshaft 2 to housing 7 (the crankshaft) and satisfactorily improving a responsiveness of intake-valve timing control.

Furthermore, two small-diameter portions 15*c*-15*d* are arranged at angular positions circumferentially spaced apart from each other and diametrically opposed to each other (concretely, by approximately 180 degrees), whereas two large-diameter portions 15*e*-15*f* are arranged at angular positions circumferentially spaced apart from each other and diametrically opposed to each other (concretely, by approximately 180 degrees). As a whole, the weight of vane rotor 9 can be circumferentially balanced and uniformed, thereby avoiding rotational unbalance of vane rotor 9. This ensures a smooth rotary motion of vane rotor 9 relative to housing 7.

Additionally, two large-diameter portions 15*e*-15*f* are arranged at angular positions circumferentially spaced apart from each other by an angular range of approximately 180 degrees greater than 120 degrees. When fixing the rotor onto a machine tool (e.g., a metalworking machine tool), the diametrically-opposed large-diameter portions 15*e*-15*f* can be easily secured or grasped in a chuck. Thus, the working efficiency can be improved.

Additionally, in the embodiment, when the engine is automatically stopped, vane rotor 9 can be locked or held at the maximum phase-retard angular position mechanically by means of the lock mechanism 4, rather than hydraulically. This eliminates the necessity of a separate hydraulic pressure source for holding the vane rotor at the maximum phase-retard angular position. This contributes to more simplified VTC apparatus and reduced system costs.

Additionally, in the embodiment, a function of hydraulic-pressure control for each of the hydraulic pressure chambers (phase-retard chamber 11 and phase-advance chamber 12) and a function of hydraulic-pressure control for each of first, second, and third unlocking pressure-receiving chambers 32-34 are both achieved by means of the single electromagnetic directional control valve 41. Thus, it is possible to enhance the flexibility of layout of the VTC system on the engine body, thus ensuring lower system installation time and costs.

Furthermore, it is possible to enhance the ability to hold the angular position of vane rotor 9 relative to sprocket 1 at the intermediate-phase angular position by means of the lock mechanism 4, when the engine is manually stopped. Additionally, by virtue of the second lock guide groove (the two-stage stepped lock guide groove with two bottom faces 25*a*-25*b*, serving as a one-way clutch, in other words, a ratchet) and the third lock guide groove (the two-stage stepped lock guide groove with two bottom faces 26*a*-26*b*, serving as a one-way clutch, in other words, a ratchet), movement of second lock pin 28 only into engagement with the second lock hole 25 and movement of third lock pin 29 only into engagement with the third lock hole 26 are permitted, thus assuring more safe and certain guiding action for movement of lock pins 28-29 into engagement.

Even when vane rotor 9 tends to rotate relative to sprocket 1 in the phase-retard direction owing to the positive torque, it is possible to safely certainly guide the vane rotor 9 toward the intermediate-phase angular position by virtue of a long four-stage ratchet action, created by two bottom faces 25*a*-25*b* of second lock hole 25, and two bottom faces 26*a*-26*b* of third lock hole 26.

Hydraulic pressure in each of phase-retard chamber 11 and phase-advance chamber 12 is not used as hydraulic pressure acting on each of first, second, and third unlocking pressure-receiving chambers 32-34. In comparison with a system that hydraulic pressure in each of phase-retard chamber 11 and phase-advance chamber 12 is also used as hydraulic pressure acting on each of unlocking pressure-receiving chambers, a responsiveness of the hydraulic system of the embodiment to hydraulic pressure supply to each of unlocking pressure-receiving chambers 32-34 can be greatly improved. Thus, it is possible to improve a responsiveness of each of lock pins 27-29 to backward movement for unlocking (disengaging). Also, the hydraulic system of the embodiment, in which hydraulic pressure can be supplied to each of unlocking pressure-receiving chambers 32-34 without using hydraulic pressure in each of phase-retard chamber 11 and phase-advance chamber 12, more concretely, the single electromagnetic directional control valve 41 eliminates the need for a fluid-tight sealing device between each of phase-retard chamber 11 and phase-advance chamber 12 and each of unlocking pressure-receiving chambers 32-34.

In addition to the above, in the shown embodiment, lock mechanism 4 is comprised of three separate lock devices, that is, (i) the first lock pin 27 and the first lock guide groove with bottom face 24*a* (ii) the second lock pin 28 and the second lock guide groove (the two-stage stepped groove) with first and second bottom faces 25*a*-25*b*, and (iii) the third lock pin 29 and the third lock guide groove (the two-stage stepped groove) with first and second bottom faces 26*a*-26*b*. Hence, it is possible to reduce the wall thickness of sprocket 1 in which each of lock holes 24-26 is formed. In more detail, for instance assume that the lock mechanism is constructed by a single lock pin and a single lock guide groove (a single multi-stage stepped groove). In such a case, five bottom faces have to be formed in the sprocket in a manner so as to continuously lower stepwise from the phase-retard side to the phase-advance side. As a matter of course, to provide the five-stage stepped groove, the wall thickness of the sprocket also has to be increased. In contrast, the embodiment adopts three separate lock devices (27, 24*a*; 28, 25*a*-25*b*; 29, 26*a*-26*b*) as the lock mechanism, and hence it is possible to reduce the thickness of sprocket 1, thereby shortening the axial length of the VTC apparatus and consequently enhancing the flexibility of layout of the VTC system on the engine body.

Second Embodiment

Figure 12:
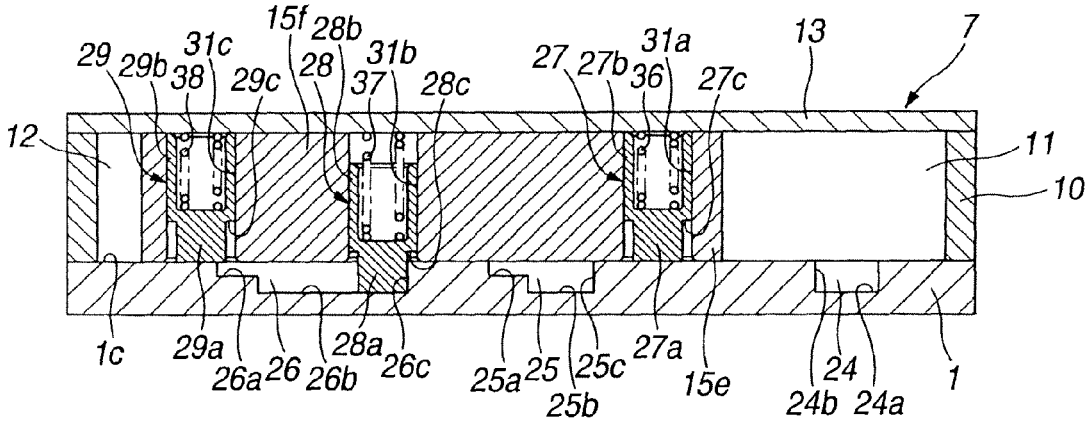
FIG. 12 is a development cross-sectional view illustrating an operation of each of lock pins with the vane rotor of the VTC apparatus of the second embodiment held at the maximum phase-retard position.

Referring now to FIG. 12, there is shown the development cross section of the VTC apparatus of the second embodiment. The VTC apparatus of the second embodiment shown in FIG. 12 differs from the first embodiment shown in FIGS. 1-11, in that the structure and configuration of lock mechanism 4 for locking vane rotor 9 at the maximum phase-retard angular position, is somewhat modified.

Concretely, the second lock pin 28 is installed in the second large-diameter portion 15*f* of rotor 15 via the second lock-pin hole 31*b*, and arranged adjacent to the third lock pin 29. Additionally, the second lock hole 25, with which the second lock pin 28 slides into and out of engagement, is arranged on the side of second large-diameter portion 15*f* and formed in the inner face 1*c* of sprocket 1.

As seen in FIG. 12, when vane rotor 9 has rotated relative to sprocket 1 and reached the maximum phase-retard position, the first lock pin 27 is kept in abutted-engagement with the inner face 1*c* of sprocket 1 under preload (by the bias of first spring 36). On the other hand, the second lock pin 28 is brought into abutted-engagement with the second bottom face 26*b* of third lock hole 26. The other construction of the VTC apparatus of the second embodiment of FIG. 12 is the same as that described for the first embodiment.

Therefore, the second embodiment can provide the same operation and effects as the first embodiment. In particular, when the engine is automatically stopped by means of an idling-stop system, as previously discussed, vane rotor 9 becomes placed into the maximum phase-retard angular position as shown in FIG. 3 by a working-fluid supply to each of phase-retard chambers 11. At this time, as clearly shown in FIG. 12, the axial end face of the tip 28*a* of second lock pin 28 is brought into abutted-engagement with the second bottom face 26*b* of third lock hole 26 and simultaneously the outer periphery (the edge) of the tip 28*a* of second lock pin 28 is also brought into abutted-engagement with the phase-advance side upstanding inner face 26*c*, so as to restrict rotary motion of vane rotor 9 in the phase-advance direction. Hence, intake valve closure timing (IVC) can be controlled to and held at a timing value corresponding to the maximum retarded phase, thereby more effectively adequately suppressing noise and vibrations, which may be produced when automatically restarting the engine, that is, at the beginning of cranking.

In a similar manner to the first embodiment, in the VTC apparatus of the second embodiment, the locking action, by which vane rotor 9 is locked and held at the maximum phase-retard angular position, can be attained mechanically by the second lock pin 28 engaged with the third lock hole 26, rather than hydraulically. This contributes to more simplified VTC apparatus and reduced system costs.

It will be appreciated that the invention is not limited to the particular embodiments shown and described herein, but that various changes and modifications may be made. The valve timing control (VTC) apparatus of the shown embodiment is exemplified in the phase control apparatus applied to an intake-valve side of an internal combustion engine. In lieu thereof, the VTC apparatus may be used for a phase control apparatus installed on an exhaust-valve side.

In the shown embodiment, the number of lock pins of the lock mechanism 4 is "3". As can be appreciated from the above, the fundamental concept of the invention may be applied to a valve timing control apparatus equipped with a lock mechanism having three or more lock pins, e.g., four lock pins, either one of which pins is configured to mechanically lock or hold the vane rotor 9 at the maximum phase-retard angular position.

The entire contents of Japanese Patent Application No. 2011-234693 (filed Oct. 26, 2011) are incorporated herein by reference.

While the foregoing is a description of the preferred embodiments carried out the invention, it will be understood that the invention is not limited to the particular embodiments shown and described herein, but that various changes and modifications may be made without departing from the scope or spirit of this invention as defined by the following claims.

What is claimed is:

1. A valve timing control apparatus of an internal combustion engine, comprising:

a housing adapted to be driven by a crankshaft of the engine, and configured to define a working-fluid chamber therein by partitioning an internal space by shoes protruding radially inward from an inner peripheral surface of the housing;

a vane rotor having a rotor adapted to be fixedly connected to a camshaft and radially-extending vanes formed on an outer periphery of the rotor for partitioning the working-fluid chamber of the housing by the shoes and the vanes to define phase-advance hydraulic chambers and phase-retard hydraulic chambers;

a stopper for restricting an angular range of relative rotation of the vane rotor with respect to the housing;

a first locking member located in the vane rotor and configured to extend or retract as necessary;

a second locking member located in the vane rotor and configured to extend or retract as necessary;

a first lock recessed portion located in the housing, and configured to restrict rotary motion of the vane rotor relative to the housing in a phase-retard direction from an intermediate lock position between a maximum phase-advance position and a maximum phase-retard position by engagement of the first locking member with the first lock recessed portion; and a second lock recessed portion located in the housing, and configured to restrict rotary motion of the vane rotor relative to the housing in a phase-advance direction from the intermediate lock position by engagement of the second locking member with the second lock recessed portion, and configured to hold the vane rotor at the intermediate lock position in cooperation with engagement of the first locking member with the first lock recessed portion, and further configured to hold the vane rotor at the maximum phase-retard position by restricting the rotary motion of the vane rotor in the phase-advance direction by engagement of the first locking member with the second lock recessed portion under a state where the rotary motion of the vane rotor relative to the housing in the phase-retard direction is restricted by the stopper.

2. The valve timing control apparatus as claimed in claim 1, wherein:

the first and second locking members are located in the rotor.

3. The valve timing control apparatus as claimed in claim 1, wherein:

the rotor has a large-diameter portion and a small-diameter portion; and the first and second locking members are located in the large-diameter portion.

4. The valve timing control apparatus as claimed in claim 3, wherein:

a radial length of a first shoe of the shoes, facing the large-diameter portion, and a radial length of a second shoe of the shoes, facing the small-diameter portion, are dimensioned to differ from each other so as to be substantially conformable to respective outer peripheral surfaces of the large-diameter portion and the small-diameter portion.

5. The valve timing control apparatus as claimed in claim 1, wherein:

a bottom of the second lock recessed portion is formed as a stepped portion whose bottom face lowers stepwise in the phase-advance direction.

6. The valve timing control apparatus as claimed in claim 5, which further comprises:

a third locking member located in the vane rotor and configured to extend or retract as necessary; and a third lock recessed portion located in the housing, and having a stepped portion whose bottom face lowers stepwise in the phase-advance direction, and configured to guide the first locking member toward the first lock recessed portion by virtue of movement of the third locking member into engagement with the third lock recessed groove.

7. The valve timing control apparatus as claimed in claim 6, wherein:

the first, second, and third locking members are located in the rotor.

8. The valve timing control apparatus as claimed in claim 7, wherein:

the rotor has at least two large-diameter portions and at least two small-diameter portions; and the first, second, and third locking members are located in the large-diameter portions rather than the small-diameter portions.

9. The valve timing control apparatus as claimed in claim 8, wherein:

the vanes comprise four vanes;

the rotor has one of the at least two large-diameter portions formed between a first group of adjacent vanes of the four vanes, another of the at least two large-diameter portions formed between a second group of adjacent vanes of the four vanes, one of the at least two small-diameter portions formed between a third group of adjacent vanes of the four vanes, and another of the at least two small-diameter portions formed between a fourth group of adjacent vanes of the four vanes; and the first and second locking members are located in the one of the at least two large-diameter portions, whereas the third locking member is located in the another of the at least two large-diameter portions.

10. The valve timing control apparatus as claimed in claim 9, wherein:

the large-diameter portions are arranged to be substantially diametrically opposed to each other; and the small-diameter portions are arranged to be substantially diametrically opposed to each other.

11. The valve timing control apparatus as claimed in claim 1, wherein:

the stopper comprises two specified shoes of the shoes, one of the two specified shoes serving as a maximum phase-retard side stopper by abutment with an associated vane of the vanes, and the other of the two specified shoes serving as a maximum phase-advance side stopper by abutment with the associated vane.

12. The valve timing control apparatus as claimed in claim 1, which further comprises:

a first biasing member for permanently biasing the first locking member in an extending direction of movement of the first locking member into engagement with the first lock recessed portion by a biasing force of the first biasing member; and a second biasing member for permanently biasing the second locking member in an extending direction of movement of the second locking member into engagement with the second lock recessed portion by a biasing force of the second biasing member, wherein a backward movement of each of the first and second locking members in a retracting direction of movement of each of the first and second locking members out of engagement with the respective lock recessed portions against the biasing forces is created by a supply of hydraulic pressure.

13. The valve timing control apparatus as claimed in claim 12, wherein:

hydraulic pressure is supplied to each of the first and second locking members via a hydraulic circuit independent of a hydraulic circuit provided for hydraulic-pressure supply-and-exhaust for each of the phase-advance hydraulic chambers and a hydraulic circuit provided for hydraulic-pressure supply-and-exhaust for each of the phase-retard hydraulic chambers.

14. The valve timing control apparatus as claimed in claim 2, wherein:

the second locking member is kept out of engagement with the second lock recessed portion, under a state where the first locking member is kept in engagement with the second lock recessed portion.

15. The valve timing control apparatus as claimed in claim 8, wherein:

the second locking member is kept out of engagement with the second lock recessed portion and simultaneously the third locking member is kept out of engagement with the third lock recessed portion, under a state where the first locking member is kept in engagement with the second lock recessed portion.

16. The valve timing control apparatus as claimed in claim 1, wherein:

a tip of the first locking member, which slides into engagement with any one of the first and second lock recessed portions, and a tip of the second locking member, which slides into engagement with the second lock recessed portion, are both formed into a cylindrical shape.

17. The valve timing control apparatus as claimed in claim 6, wherein:

a tip of the first locking member, which slides into engagement with any one of the first and second lock recessed portions, a tip of the second locking member, which slides into engagement with the second lock recessed portion, and a tip of the third locking member, which slides into engagement with the third lock recessed portion, are all formed into a cylindrical shape.

18. A valve timing control apparatus of an internal combustion engine, comprising:

a driving rotary member adapted to be driven by a crankshaft of the engine;

a driven rotary member adapted to be fixedly connected to a camshaft and configured to change, depending on an operating condition of the engine, a relative-rotation angle of the driven rotary member with respect to the driving rotary member within a predetermined angular range;

a phase change mechanism having phase-advance hydraulic chambers and phase-retard hydraulic chambers, and configured to rotate the driven rotary member relative to the driving rotary member in a phase-advance direction by supplying hydraulic pressure to each of the phase-advance hydraulic chambers and exhausting working fluid from each of the phase-retard hydraulic chambers and configured to rotate the driven rotary member relative to the driving rotary member in a phase-retard direction by supplying hydraulic pressure to each of the phase-retard hydraulic chambers and exhausting working fluid from each of the phase-advance hydraulic chambers;

a first locking member and a second locking member, each of which is configured to extend or retract as necessary;

a first lock recessed portion configured to restrict rotary motion of the driven rotary member relative to the driving rotary member in a phase-retard direction from an intermediate lock position between a maximum phase-advance position and a maximum phase-retard position by engagement of the first locking member with the first lock recessed portion; and a second lock recessed portion configured to restrict rotary motion of the driven rotary member relative to the driving rotary member in a phase-advance direction from the intermediate lock position by engagement of the second locking member with the second lock recessed portion, and configured to hold the driven rotary member at the maximum phase-retard position by engagement of the first locking member with the second lock recessed portion.

19. A valve timing control apparatus of an internal combustion engine, comprising:

a housing adapted to be driven by a crankshaft of the engine, and configured to define a working-fluid chamber therein;

a vane rotor having a rotor adapted to be fixedly connected to a camshaft and vanes for partitioning the working-fluid chamber into phase-advance hydraulic chambers and phase-retard hydraulic chambers, and configured to phase-advance with respect to the housing by supplying hydraulic pressure to each of the phase-advance hydraulic chambers, while exhausting working fluid from each of the phase-retard hydraulic chambers and configured to phase-retard with respect to the housing by supplying hydraulic pressure to each of the phase-retard hydraulic chambers, while exhausting working fluid from each of the phase-advance hydraulic chambers;

a first locking member located in the vane rotor and configured to extend or retract as necessary;

a second locking member located in the vane rotor and configured to extend or retract as necessary;

a first lock recessed portion located in the housing, and configured to restrict rotary motion of the vane rotor relative to the housing in a phase-retard direction from an intermediate lock position between a maximum phase-advance position and a maximum phase-retard position by engagement of the first locking member with the first lock recessed portion; and a second lock recessed portion located in the housing, and configured to restrict rotary motion of the vane rotor relative to the housing in a phase-advance direction from the intermediate lock position by engagement of the second locking member with the second lock recessed portion, and further configured to hold the vane rotor at the maximum phase-retard position by engagement of the first locking member with the second lock recessed portion.

* * * * *